US007059166B2

(12) United States Patent
Bowles et al.

(10) Patent No.: US 7,059,166 B2
(45) Date of Patent: Jun. 13, 2006

(54) METHOD AND APPARATUS FOR ASSURING OR DETERMINING APPROPRIATE CLOSURE OF A CRIMP ASSEMBLY

(75) Inventors: Richard R Bowles, Solon, OH (US); James E Hamm, Grafton, OH (US); Paul W Gress, Bay Village, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/462,874

(22) Filed: Jun. 16, 2003

(65) Prior Publication Data

US 2003/0230131 A1 Dec. 18, 2003

Related U.S. Application Data

(60) Provisional application No. 60/389,369, filed on Jun. 17, 2002.

(51) Int. Cl.
*B21D 39/04* (2006.01)

(52) U.S. Cl. ..... 72/413; 72/416; 72/409.19; 29/237; 81/389; 81/418

(58) Field of Classification Search ..... 72/416, 72/413, 292, 409.01, 409.19; 29/237, 751; 81/341, 385, 386, 388, 389, 395, 111, DIG. 11, 81/418

See application file for complete search history.

(56) References Cited

U.S. PATENT DOCUMENTS

| | | | | |
|---|---|---|---|---|
| 399,071 | A * | 3/1889 | Patrick | 7/133 |
| 758,504 | A * | 4/1904 | Bolding | 72/409.13 |
| 964,600 | A * | 7/1910 | Adams | 30/90.6 |
| 1,389,584 | A * | 9/1921 | Goodridge | 59/2 |
| 1,578,438 | A * | 3/1926 | Hintz | 30/186 |
| 2,800,867 | A * | 7/1957 | Smith | 269/189 |
| 2,826,106 | A * | 3/1958 | Schegulla | 72/31.11 |
| 3,940,838 | A * | 3/1976 | Gryctko | 29/751 |
| 4,043,174 | A * | 8/1977 | Paolino | 72/412 |
| 5,611,229 | A * | 3/1997 | Chadbourne et al. | 72/31.01 |
| 5,824,906 | A | 10/1998 | Lohmann | 73/597 |
| 5,878,617 | A * | 3/1999 | Parker | 72/409.12 |
| 6,035,775 | A | 3/2000 | Nghiem | 100/43 |
| 6,044,681 | A * | 4/2000 | Frenken | 72/292 |

(Continued)

FOREIGN PATENT DOCUMENTS

DE 19631019 8/1997

(Continued)

OTHER PUBLICATIONS

U.S. Appl. No. 10/301,637, filed Nov. 22, 2002, Hans Joerg Goop, pending.

*Primary Examiner*—Daniel C. Crane
(74) *Attorney, Agent, or Firm*—Locke Liddell & Sapp LLP

(57) ABSTRACT

Methods and apparatus are disclosed for assuring or determining appropriate closure of a crimp ring assembly. In some embodiments, positive stopping apparatus on the crimp ring are used to assure appropriate closure of a crimp ring assembly. The positive stopping apparatus may be adjustable or non-adjustable and may be positioned on the free ends or adjoined ends of the segments of the crimp ring. In some embodiments, adjustable and/or cam operating pivot connections on the crimp ring are used to assure appropriate closure of a crimp ring assembly. In some embodiments, sensing apparatus or systems are disclosed for assuring or determining appropriate closure of a crimp ring assembly.

18 Claims, 17 Drawing Sheets

U.S. PATENT DOCUMENTS

| | | | | |
|---|---|---|---|---|
| 6,044,686 | A * | 4/2000 | Dischler | 72/402 |
| 6,058,755 | A * | 5/2000 | Viegener | 72/292 |
| 6,164,106 | A | 12/2000 | Nghiem et al. | 72/20.1 |
| 6,202,290 | B1 | 3/2001 | Kewitz et al. | 29/701 |
| 6,244,085 | B1 | 6/2001 | Dummermuth | 72/31.1 |
| 6,378,194 | B1 | 4/2002 | Nghiem | 29/516 |
| 6,457,338 | B1 | 10/2002 | Frenken | 72/20.1 |
| 2001/0032490 | A1 | 10/2001 | Goop | 72/416 |

FOREIGN PATENT DOCUMENTS

| | | |
|---|---|---|
| EP | 0860245 | 8/1998 |
| EP | 0941813 | 9/1999 |
| EP | 0860220 | 3/2001 |
| EP | 0860223 | 3/2001 |
| EP | 1103349 | 5/2001 |
| EP | 1142655 | 10/2001 |
| EP | 0824979 | 4/2002 |
| EP | 1092487 | 10/2002 |

* cited by examiner

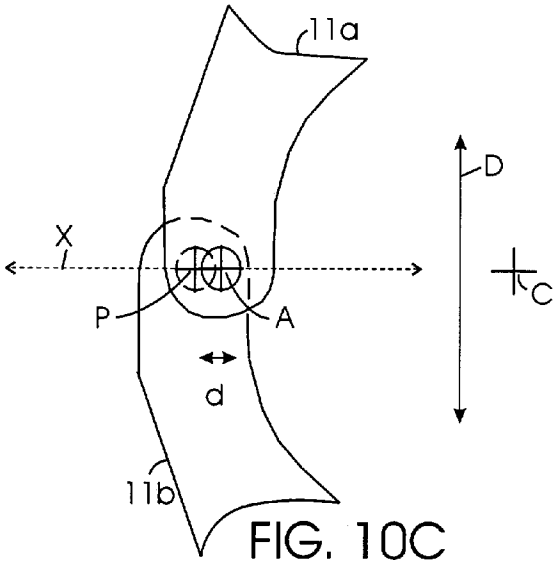
FIG. 10A
FIG. 10C
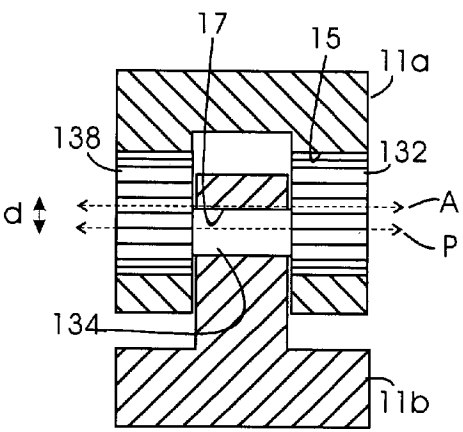
FIG. 10B
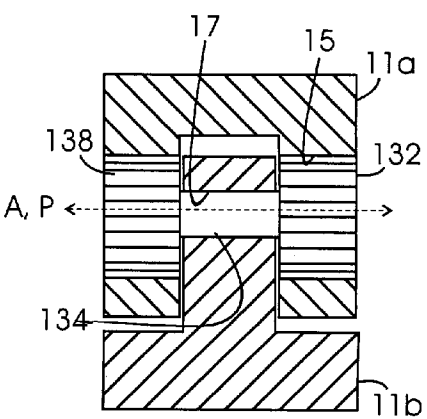
FIG. 10D

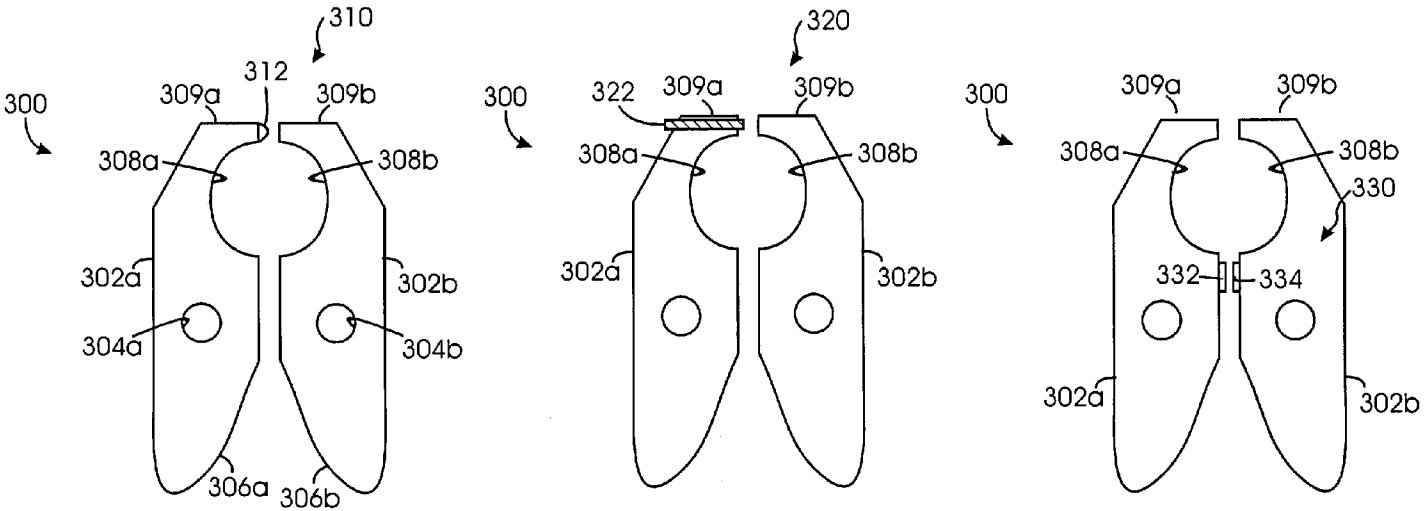
FIG. 13A
(Prior Art)
FIG. 13B
FIG. 13C
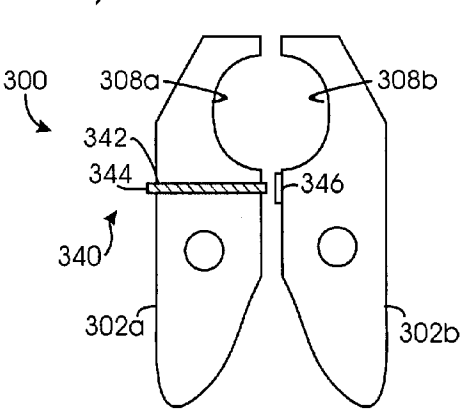
FIG. 13D
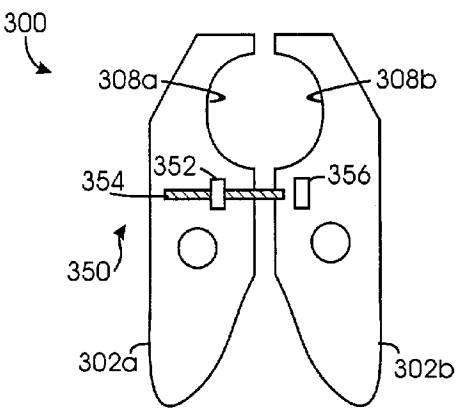
FIG. 13E

METHOD AND APPARATUS FOR ASSURING OR DETERMINING APPROPRIATE CLOSURE OF A CRIMP ASSEMBLY

CROSS REFERENCE TO RELATED APPLICATIONS

This application claims priority to U.S. Provisional Application Ser. No. 60/389,369 filed Jun. 17, 2002, which is incorporated by reference herein in its entirety.

FIELD OF THE INVENTION

The present invention relates generally to crimping tools and crimp rings, chains, and jaws and, more particularly to methods and apparatus for assuring or determining appropriate closure of crimp assemblies about a fitting.

BACKGROUND OF THE INVENTION

A compression fitting is typically a tubular sleeve that is made of plastic or metal and may contain seals. To produce a joint between two ends of pipe, the fitting is slid over the ends of the pipes and then compressed radially. The fitting forms a leak resistant joint between the pipe ends. The joint has considerable mechanical strength and is self-supporting. Compression fittings for such joints are typically used when installing liquid or gas-carrying pipework in buildings. It is essential that the fitting be sufficiently compressed to guarantee absolute tightness for both mechanical strength and leak resistance.

A crimping tool, such as known in the art, may be used to compress the fitting on the pipe ends. A typical crimping tool includes at least two arms or jaws. A drive mechanism is used to move the jaws. The drive mechanism can include a hydraulic piston acted upon by hydraulic pressure via a manually driven or electric motor-driven pump within the tool. In some embodiments, at least a portion of the jaws may be moved radially inward during the crimping operation to directly crimp the fitting. In other embodiments, the arms of an actuator may actuate a crimp ring, sling, or chain that moves inwardly to crimp the fitting. The crimp ring may typically include two to seven ring segments connected together. The actuator arms of the crimping tool couple to pivot ports or indentations defined in the crimp ring. In general, crimp rings are used to crimp larger fittings having diameters greater than approximately 2.5 inches, but can be used on all sizes. Some existing crimp slings are used on diameters as small as 42-mm or 1½", such as the multi-segment crimp slings made by Novopress for use on the Mapress fitting system.

The material deformation of the fitting by the jaws or crimp ring is preferably uninterrupted over the circumference of the fitting. Unfortunately, typical crimp jaws or crimp rings may not always give an ideal or near ideal crimp on the fitting, especially when the fitting has a large diameter. For example, typical jaws or crimp ring assemblies according to the prior art may not uniformly apply a crimping force to the fitting over the full displacement of the drive mechanism. In addition, typical jaws or crimp ring assemblies may not apply a uniform radial force to the outside circumference of the fitting during the crimping operation. Furthermore, the output force versus displacement of the drive mechanism achieved with prior art crimp ring assemblies may not be consistent when used with fittings of various sizes, materials, or tolerances.

Other situational problems may also exist that result in an incomplete crimp of the fitting. The rollers of the tool, tool force output, jaws, arms, fittings, crimp rings, and pipes are subject to differing tolerances which, if they add up unfavorably, may lead to insufficient compression of the fitting. Any inaccuracy in the manufacture of the crimping tool, jaws, ring, pipe, or fitting can affect the crimp produced. The crimping tool, jaws, ring, pipe, or fitting may also be influenced by ambient temperature or operating temperatures.

As one consequence of the problems discussed above, typical jaws or crimp rings may over-press a fitting. Over-pressing of the fitting may not necessarily occur for fittings up to 2-inches. For such smaller fittings, tips of the jaws may touch during the crimping operation, limiting the amount of crimp of the fitting. The detrimental effect of excessive tool force, however, can increase bending stress of the jaw arms for these sized fittings. The increased bending stress leads to premature fatigue of the jaws. There is a logarithmic relationship between alternating bending stress and fatigue life such that a small increase in alternating stress can yield a significant reduction in fatigue life. This only applies to designs where stress is high enough that fatigue life is considered finite (typically less than $10^6$ or $10^7$ cycles).

It is possible to over-press large fittings, such as 2½" to 4" ProPress XL fittings, when crimping the larger fitting with a crimp ring. The tips of the crimp ring segments do not touch, so that the amount of crimp of the fitting is not limited by a mechanical stop. If the tips do not touch, the stress of the ring is not increased, and the life of the ring is not reduced. However, the fitting can be over-pressed, which could result in detrimental effects of the crimped fitting, such as over-stress, breaking of the fitting, or kinking of the tube inserted in the fitting. In addition, over-crimping results in the rollers of the tool contacting the actuator cam at a different location. This may result in increased bending stress in the actuator arm, which will reduce the life of the actuator arm.

In another consequence, the crimp produced on the fitting may be incomplete and the tightness of the joint may not be guaranteed. Therefore, it is desirable that jaws or crimp rings use enough of the work available from the crimp tool to make a good crimp on the fitting, but not unduly shorten the life of the jaws through fatigue. It is also desirable that jaws or crimp rings be able to overcome some of the problems discussed above.

The present invention is directed to overcoming, or at least reducing the effects of, one or more of the problems set forth above.

SUMMARY OF THE DISCLOSURE

Methods and apparatus for assuring or determining appropriate closure of crimp assemblies are disclosed. The crimp assemblies include, but are not limited to, crimp rings, crimp chains, actuator arms for actuating crimp rings or chains, or jaws for directly crimping a fitting. In some embodiments, the positive stopping apparatus on the crimp assembly assures appropriate closure of the assembly about a fitting. The positive stopping apparatus may be non-adjustable or adjustable. The positive stopping apparatus may be positioned on the free ends or adjoined ends of segments of a crimp ring. In other embodiments, adjustable pivot connections assure appropriate closure of a crimp ring assembly about a fitting. In still other embodiments, sensing apparatus or systems are disclosed for assuring or determining appropriate closure of a crimp assembly.

BRIEF DESCRIPTION OF THE DRAWINGS

The foregoing summary, preferred embodiments, and other aspects of subject matter of the present disclosure will be best understood with reference to a detailed description, which follows, when read in conjunction with the accompanying drawings, in which:

FIGS. 8, 9A–B, and 10A–D illustrate an embodiment of an eccentric pivot connection for a crimp ring according to the present invention.

FIGS. 13A–E illustrate embodiments of positive stopping apparatus for jaws of a crimp assembly according to the present invention.

Figure 1B:
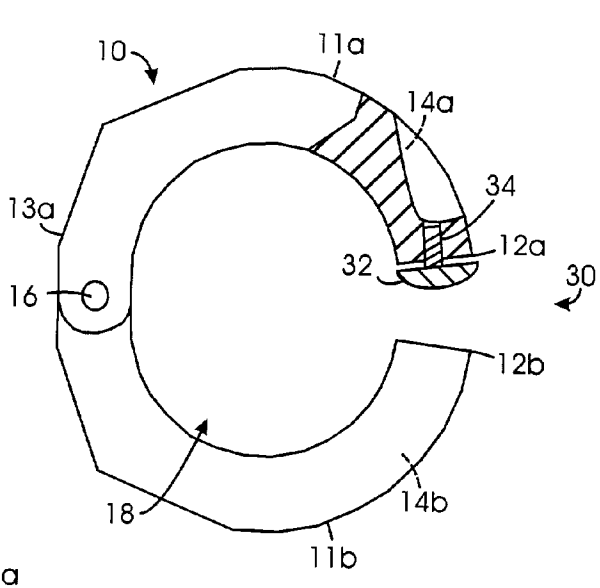
FIGS. 1A–C illustrate embodiments of positive stopping apparatus on free ends of a crimp ring according to the present invention.

While the subject matter of the present disclosure is susceptible to various modifications and alternative forms, specific embodiments have been shown by way of example in the drawings and are herein described in detail. The figures and written description are not intended to limit the scope of the inventive concepts in any manner. Rather, the figures and written description are provided to illustrate the inventive concepts to any person skilled in the art by reference to particular embodiments, as required by 35 U.S.C. § 112.

DETAILED DESCRIPTION

I. Apparatus for Assuring or Determining Appropriate Closure of a Crimp Ring Assembly A about a Fitting A. Positive Stopping Apparatus on Free Ends of a Crimp Ring Referring to FIGS. 1A–C, wherein the same reference numbers indicate like elements between Figures, non-adjustable and adjustable positive stopping apparatus 20, 30, and 40 for assuring or determining appropriate closure of a crimp ring are shown. A typical crimping tool has a force stop that limits travel of the actuator arms, which may provide a force control limited to ±6%. The force stop is activated when the output force reaches a predetermined level, for example, 32 kN. Stopping the crimp operation at the maximum output force is achieved with a release mechanism or switch mechanism. For example, a torque coupling may be used for a rotating drive; a pressure relief valve may be used for a hydraulic drive; or an over-current release may be used for electrically driven drives.

In contrast to the conventional force stops of crimping tools, a positive stopping apparatus having a mechanical stop provides a more reproducible and repeatable closure of the crimp ring about a fitting. For a given fitting used to join pipes, variations may exist in the crimping operation due to differences in materials, wall thickness, elasticity of the crimping tool, differences in manufacturing tolerances, heat expansion, etc. The closure of the crimp ring with a positive stopping apparatus can be designed or adjusted to meet specific tolerances when closed about a given fitting. The tolerance can be closer to the ideal dimension for crimping the fitting. The positive stopping apparatus may be fixed or adjustable and may be located on the crimp ring, which provides for ease in manufacture.

Figure 1C:
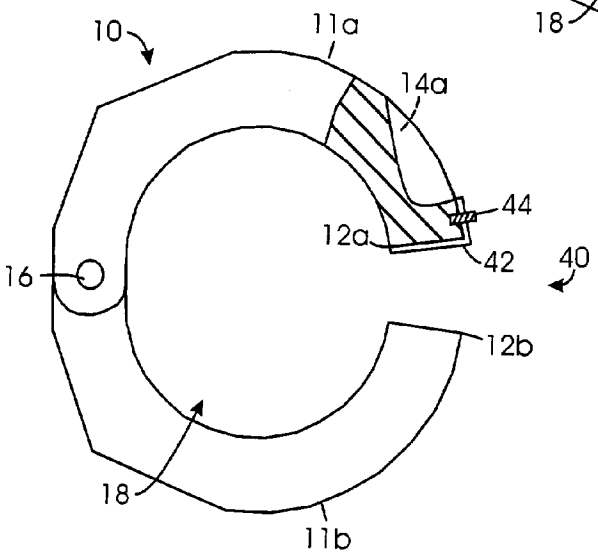
Figure 1A:
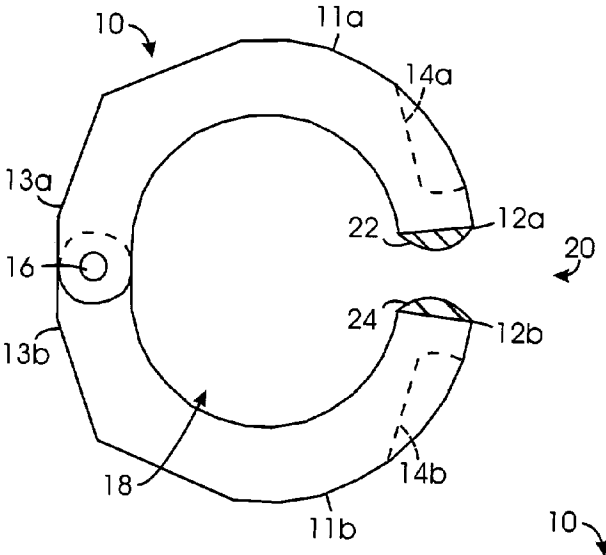

Referring to FIGS. 1A–C, a side view of a crimp ring 10 is illustrated. In general, crimp ring 10 includes a first ring segment 11*a*, a second ring segment 11*b*, and a pivot point or pin 16. Although only two ring segments 11*a* and 11*b* are illustrated herein, it is understood that a crimp ring may have two or more segments. First and second segments 11*a* and 11*b* are pivotably connected together by pivot pin 16.

First segment 11*a* includes a free end 12*a* and includes a bifurcate end 13*a* with a pivot bore defined therethrough. Second segment 11*b* includes a free end 12*b* and includes a second end 13*b* with a pivot bore defined therethrough. Second end 13*b* of the second segment is positioned within bifurcate end 13*a* of first segment 11*a*. The pivot bores are aligned with one another, and the pivot pin 16 is inserted through the respective bores. External retainers (not shown) may be attached to ends of pivot pin 16 to hold the pin in the bores.

Ring segments 11*a* and 11*b* define an opening or crimp dimension 18. A fitting (not shown) is disposed in opening 18 between segments 11*a* and 11*b*. First segment 11*a* has an actuator indentation 14*a*, and second segment 11*b* has an actuator indentation 14*b*. The actuator arms of a crimping tool (not shown) fit respectively within actuator indentations 14*a* and 14*b*. A crimping force is developed with a drive or hydraulic mechanism of the crimping tool, causing the arms of the tool to close segments 11*a* and 11*b* of the crimp ring about the fitting disposed therebetween.

In FIG. 1A, crimp ring 10 includes an embodiment of a positive stopping apparatus 20 in accordance with the present invention. Positive stopping apparatus 20 is positioned adjacent free ends 12*a* and 12*b* of ring segments 11*a* and 11*b*. Positive stopping apparatus 20 includes one or more positive stops, bosses or studs 22 and 24 to assure appropriate closure of crimp ring 10 when closed about a fitting. First segment 11*a* includes a boss or stud 22 disposed on free end 12*a*, and second segment 11*b* may also include a second boss or stud 24 disposed on its free end 12*b*. In general, the positive stop can include an adjustable shim, a screw, a machined surface, a shoulder, a tab, a head, a boss, a stud, or a nut.

Positive stop or boss 22 can be added by inserting an additional element to free end 12*a* of segment 11*a*, or it can be added by modifying the casting of a conventional ring segment. Positive stop 22 and 24 can also be integrally machined portions of ring segments 11*a* and 11*b*, respectively. Positive stop or boss 22 is machined or milled to appropriate faces and dimensions to assure that crimp ring 10 has accurate tolerances when closed about a fitting.

When the actuator arms actuate the crimp ring, segments 11*a* and 11*b* pivot about pin 16. Free ends 12*a* and 12*b* of the segments are moved together, and the one or more positive stops, bosses or studs 22 and 24 on free ends 12*a* and 12*b* engage at a predetermined point during the crimping operation. The one or more positive stops, bosses or studs 22 and 24 restrict crimp dimension 18 from being reduced past a minimum dimension. The output force is quickly ramped to a maximum level where a conventional force stop of the crimping tool ceases the crimping operation. In this way, positive stopping apparatus 20 may reduce detrimental effects described above.

Referring to FIG. 1B, crimp ring 10 includes an embodiment of an adjustable positive stopping apparatus 30 in accordance with the present invention. Adjustable positive stopping apparatus 30 is positioned at free end 12*a* of first segment 11*a*. Adjustable stopping apparatus 30 includes an adjustable stop or boss 32 with an adjusting member 34 connected to free end 12*a* of segment 11*a*. Adjusting member 34 is a threaded pin or screw for adjustably positioning the boss 32 in relation to free end 12*a* of first segment 11*a*. A locking nut or shims (not shown) can be used in conjunction with adjusting member 34 to maintain the adjusted position of boss 32 on free end 12*a* of segment 11*a*.

Adjustable stopping apparatus 30 advantageously enables an operator to change the final closed position of the crimp ring and the final dimension of ring opening 18. Using adjustable member 34, adjustable stop or boss 32 is set to an accurate distance from free end 12*a* of first segment 11*a*. Thus, the operator can calibrate or fine-tune the crimp ring with adjustable stopping apparatus 30. Adjustable stop or boss 32 assures accurate closure of crimp ring 10 about a fitting and reduces the above-mentioned, undesirable effects of over-pressing. Although one adjustable stop is illustrated, it is understood that second segment 11*b* may also include a stop or boss, either adjustable or fixed.

Referring to FIG. 1C, crimp ring 10 includes another embodiment of an adjustable positive stopping apparatus 40 in accordance with the present invention. Adjustable positive stopping apparatus 40 is positioned at free end 12*a* of first segment 11*a*. Adjustable positive stopping apparatus 40 includes a replaceable shim or spacer 42. A fastener 44 is used to attach shim 42 to free end 12*a*. One or more replaceable shims 42, of varying thickness, can be attached to free end 12*a* of segment 11*a* to change the distance of engagement between free ends 12*a* and 12*b* of segments 11*a* and 11*b*. Replaceable shims 42 assure that segments 11*a* and 11*b* meet at an appropriate tolerance when closed about a fitting.

B. Positive Stopping Apparatus on Adjoined Ends of a Crimp Ring

Figure 2B:
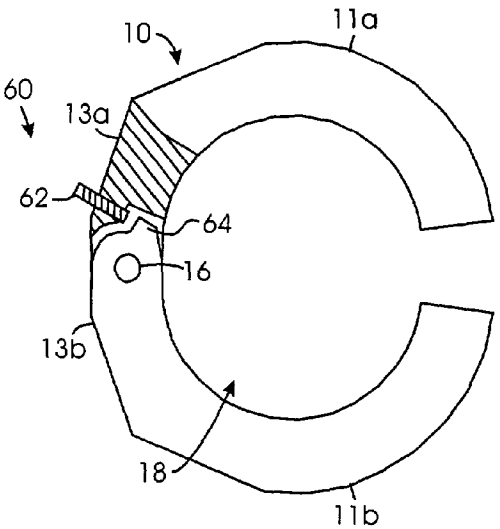
FIGS. 2A–C illustrate embodiments of positive stopping apparatus on adjoined ends of a crimp ring according to the present invention.
Figure 2C:
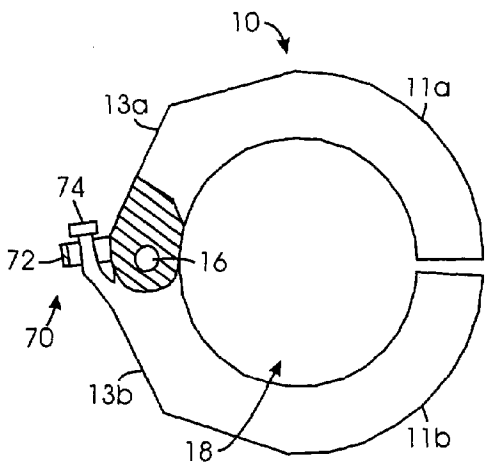
Figure 2A:
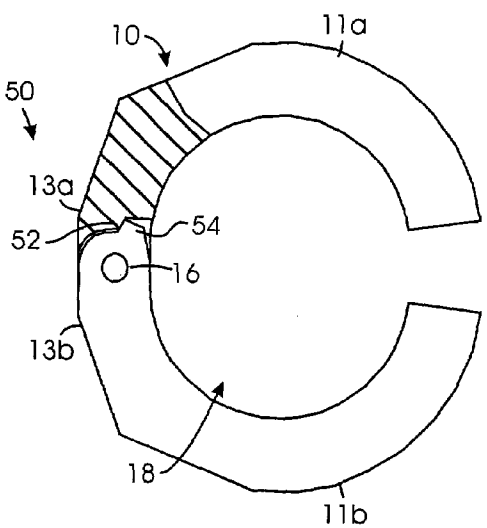

Referring to FIGS. 2A–C, embodiments of positive stopping apparatus 50, 60, and 70 are illustrated on crimp ring 10 adjacent adjoined ends 13*a* and 13*b* of segments 11*a* and 11*b*. In FIG. 2A, an embodiment of a positive stopping apparatus 50 is illustrated. Positive stopping apparatus 50 includes a first positive stopping surface 52 defined in bifurcate end 13*a* and adjacent pivot point 16 on first segment 11*a*. Positive stopping apparatus 50 also includes a second positive stopping surface 54 defined on adjoined end 13*b* of second segment 11*b* and adjacent first positive stopping surface 52.

As segments 11*a* and 11*b* of crimp ring 10 are brought together about a fitting, first and second positive stopping surfaces 52 and 54 engage, preventing further travel of segments 11*a* and 11*b* towards one another. The engagement between surfaces 52 and 54 can be pre-calibrated for a particular crimp ring and fitting size. Stopping surfaces 52 and 54 can be cast and/or machined in adjoined ends 13*a* and 13*b*. In other embodiments, crimp ring 10 can include laminated structures as disclosed below having positive stopping surfaces 52 and 54. Positive stopping surfaces 52 and 54 restrict crimp dimension 18 from being reduced beyond a minimum dimension during the crimp operation, thereby reducing the undesirable effects described above, such as overpressing the fitting.

Referring to FIG. 2B, crimp ring 10 includes an embodiment of an adjustable positive stopping apparatus 60 in accordance with the present invention. Adjustable stopping apparatus 60 includes first and second positive stops 62 and 64 positioned at adjoined ends 13*a* and 13*b* of segments 11*a* and 11*b*. At least one of the positive stops 62 and 64 is adjustable allowing an operator to fine-tune closure of crimp ring 10 about a fitting to produce a near optimal crimp. In the present embodiment, adjustable stopping surface 62 is a threaded stop disposed on first segment 11*a* adjacent pivot point 16, and second positive stopping surface 64 is on second segment 11*b* adjacent pivot point 16. Adjustable stop 62 can be set to engage fixed stop 64 to assure that crimp ring 10 closes about a fitting with appropriate tolerances.

Referring to FIG. 2C, crimp ring 10 includes another embodiment of an adjustable positive stopping apparatus 70 in accordance with the present invention. Adjustable stopping apparatus 70 is positioned outside pivot point 16 of segments 11*a* and 11*b*. Positive stopping apparatus 70 includes a first positive stop or extension 72 on first segment 11*a* adjacent pivot point 16. Positive stopping apparatus 70 also includes a second positive stop or extension 74 on second segment 11*b* adjacent pivot point 16. As segments 11*a* and 11*b* are brought together about a fitting, first and second positive stops or extensions 72 and 74 engage one another to prevent over-pressing.

At least one of positive stops or extensions 72 or 74 is adjustable allowing an operator to fine-tune closure of the crimp ring about a fitting. For example, first positive stop 72 can be an adjustable stop, such as a nut or the like, that can be moved and locked in different positions along the length of a threaded extension. The second positive stop 74 can include an extension with a slot having the threaded extension disposed therethrough. As the first and second segments are moved in relation to one another about the pivot location, the nut of the adjustable stop 72 can engage the extension of the stop 74. By adjusting the position of the adjustable stop 72, the final closed dimension of the crimp ring can be determined.

C. Adjustable Pivot Connections for a Crimp Ring

In addition to the non-adjustable and adjustable positive stopping apparatus discussed above, adjustable pivot connections between the segments can also be used to assure appropriate closure of a crimp ring about a fitting. The adjustable pivot connections may be used independently from or in combination with embodiments of the positive stopping apparatus discussed above.

Providing adjustment at the pivot connections of segments allows the segments to better encompass or wrap around the fitting. In addition, adjustable pivot connections may allow the segments to apply radial force more uniformly about the outer circumference of the fitting. To provide adjustable pivot connections, one or more of the ring segments may share an adjustable pivot point. Alternatively, each ring segment may have its own pivot point, one or both of which may be adjustable. Embodiments of adjustable pivot connections of the ring segments according to the present invention are illustrated below with reference to FIGS. 3–10.

Figure 3B:
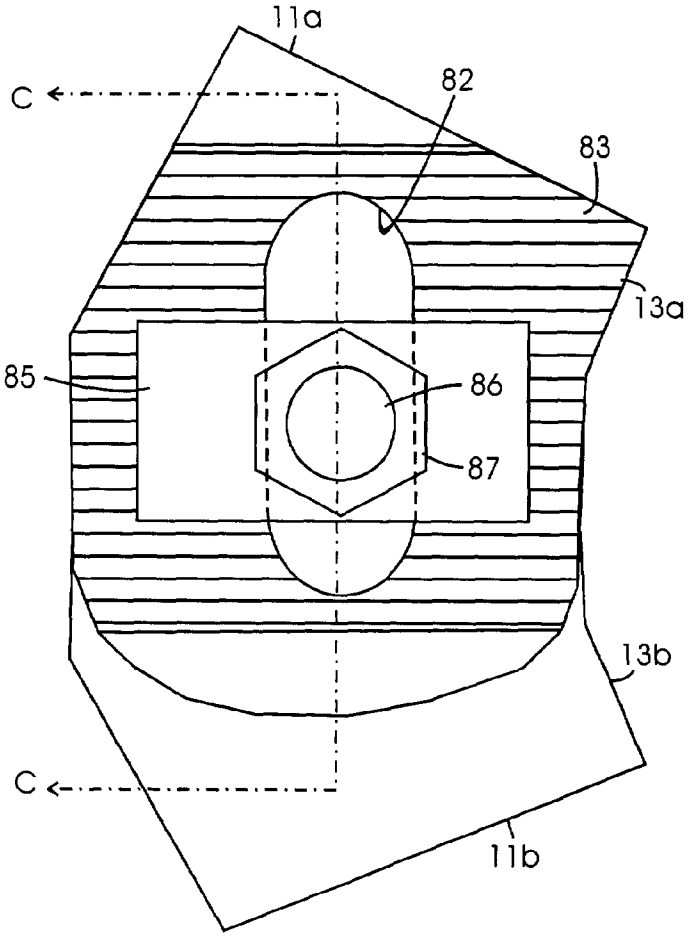
FIGS. 3B–C illustrate an embodiment of a locking mechanism for the adjustable/cam operating pivot connection of FIG. 3A.
Figure 3A:
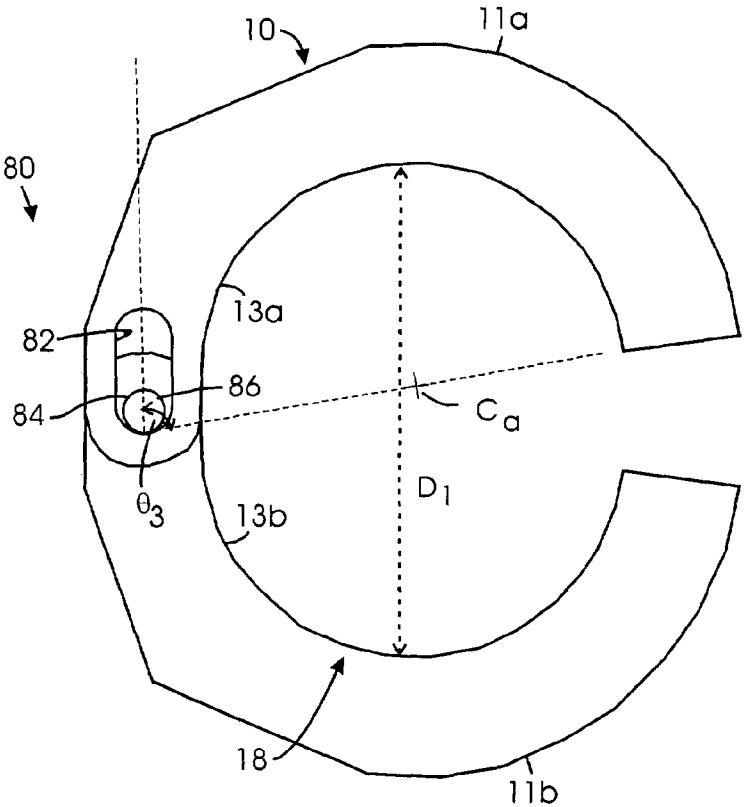
FIG. 3A illustrates an embodiment of an adjustable/cam operating pivot connection of a crimp ring according to the present invention.

Referring to FIG. 3A, crimp ring 10 includes an adjustable apparatus 80 on adjoined ends 13*a* and 13*b* of segments 11*a* and 11*b*. A pivot pin 86 is disposed in elongated apertures 82 defined in end 13*a* of first segment 11*a* and is disposed in pivot apertures 84 in end 13*b* of second segment 11*b*. Elongated apertures 82 may have a uniform shape as illustrated or may have an irregular or curved shape in other embodiments. The position of pivot pin 86 is adjustable in elongated apertures 82. Using a locking mechanism (not shown) such as disclosed below, pivot pin 86 is tightened or locked in the adjusted position in elongated apertures 82.

By changing and locking the position of pin 86 in elongated apertures 82, the overall diameter D of the crimp dimension 18 defined between segments 11*a* and 11*b* can be adjusted. In addition, elongated apertures 82 may be oriented at an angle $\theta_3$ in relation to a relative radial center Ca of first segment 11*a*. For example, if $\theta_3$ is approximately 90-degrees, then adjusting the pin in the elongated apertures will generally only alter the overall diameter D of the crimp dimension 18. Depending on predefined angles of $\theta_3$ other than 90-degrees, segments 11*a* and 11*b* may have differing orientations or movements during the crimp operation.

Locking adjustable apparatus 80 can be used to fine-tune properties of the crimp on the fitting. In particular, adjustable apparatus 80 allows the pivot location of segments 11*a* and 11*b* to be adjusted, thereby adjusting properties of the crimp produced. For example, an operator can adjust locking adjustable apparatus 80 to change the final crimp dimension of opening 18. Thus, adjustable apparatus 80 alters properties of the crimp of the fitting to assure a more accurate crimp on the fitting.

Figure 3C:
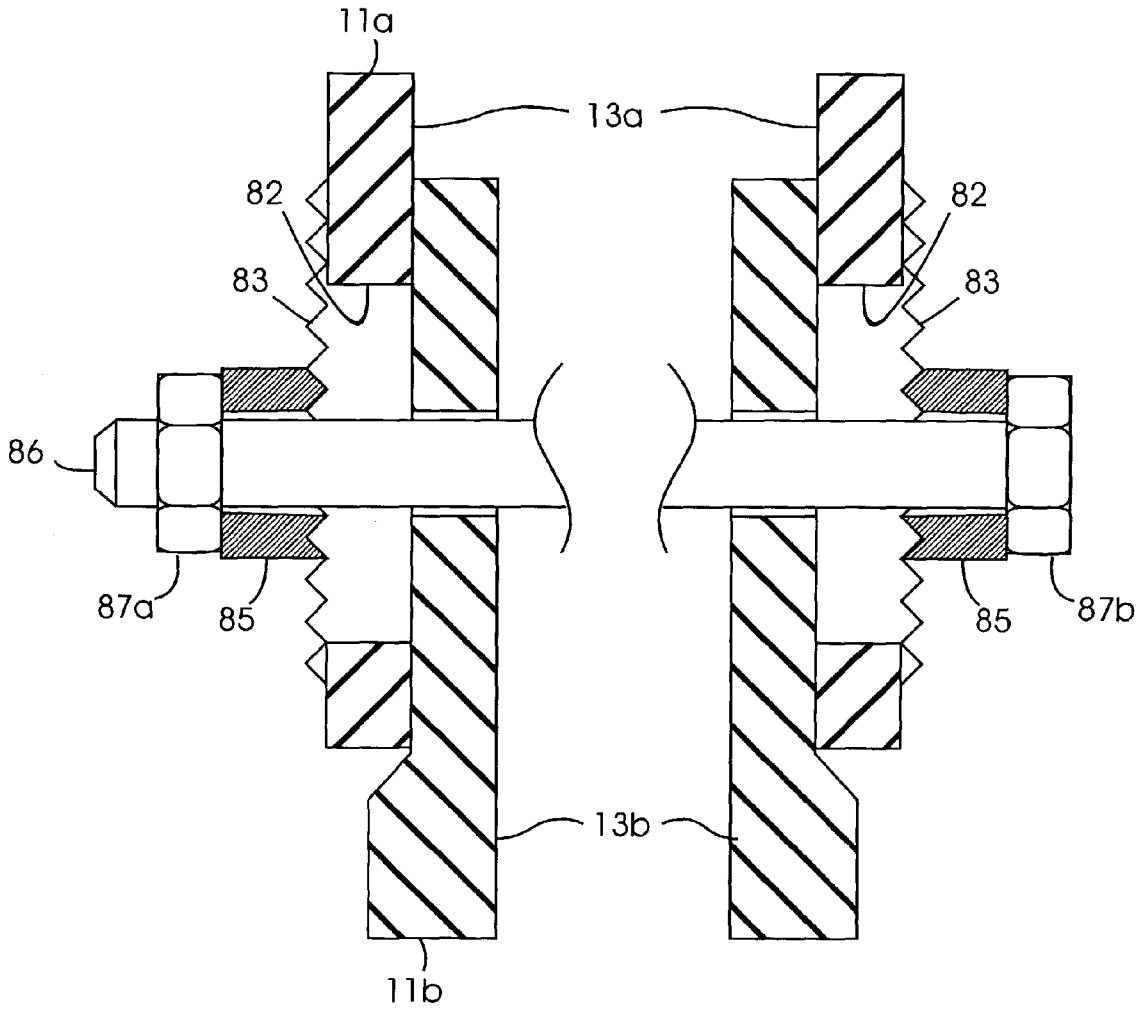

Referring to FIGS. 3B–C, an embodiment of a locking mechanism is illustrated for the adjustable pivot connection of FIG. 3A. In FIG. 3B, an enlarged side view of the pivot connection of first and second segments 11*a* and 11*b* is illustrated. In FIG. 3C, a cross-section of the pivot connection for the segments is illustrated.

As best shown in FIG. 3C, first segment 11*a* defines elongated apertures 82 in bifurcate end 13*a*, and second segment 11*b* defines pivot apertures 84 in bifurcate end 13*b*. Pivot pin 86 is disposed through elongated apertures 82 and pivot apertures 84. Serrated areas 83 on the outside surfaces of bifurcate end 13*a* are adjacent elongated apertures 82. Serrated spacers 85 are disposed on the ends of pivot pin 86. Serrated surfaces of spacers 85 engage serrated areas 83. One end of pivot pin 86 includes a bolt head 87*b*, and the other end has a nut 87*a* threaded thereon to hold the serrated spacers 85 against the serrated areas 83. Alternatively, both ends of pivot pin 86 can include nuts threaded thereon.

By loosening the nut, an operator can adjust the location of pivot pin 86 in elongated apertures 82 and the position of serrated spacers 85 on serrated areas 83. By then tightening nut 87*a*, the operator can lock serrated spaces 85 against serrated areas 83 to couple pivot pin 86 to end 13*a* at the adjusted position in elongated apertures 82. Pivot pin 86 and first end 13*a* rotate together, and pivot pin 86 freely rotates in pivot apertures 84 of second end 13*b*.

Figure 4A:
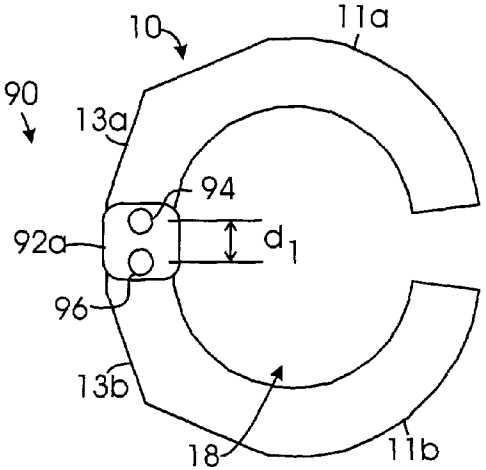
FIGS. 4A–B illustrate embodiments of intermediate linking apparatus for a crimp ring according to the present invention.

Referring to FIG. 4A, crimp ring 10 includes an adjustable pivot connection or linking apparatus 90 having an intermediate linking element 92*a*, a first pivot pin 94, and a second pivot pin 96. Intermediate linking element 92*a* adjoins ends 13*a* and 13*b* of segments 11*a* and 11*b*. Linking element 92*a* has a first aperture with first pivot pin 94 disposed therethrough and pivotably connected to first segment 11*a*. Linking element 92*a* has a second aperture with second pivot pin 96 disposed therethrough and pivotably connected to second segment 11*b*. External retainers (not shown) may connect to the ends of the pins 94 and 96 to secure the pins in the apertures.

Pivot pins 94 and 96 in intermediate linking element 92*a* are separated by a distance $d_1$. The distance $d_1$ can be predetermined or selected to facilitate an appropriate crimp for a given fitting type or size. A set of intermediate linking elements can provide various distances between the pivot pins 94 and 96. For example, intermediate linking element 92*a* can be replaced by another linking element, such as a second intermediate linking element 92*b* shown in FIG. 4B. Second intermediate linking element 92*b* includes apertures for the pins 94 and 96 separated by a second predetermined distance $d_2$ greater than the first distance $d_1$.

By replacing one linking element having one distance with a second linking element having a second distance, an operator can adjust the relationship of pivot points for the segments 11*a* and 11*b*. For example, if it is found that over-pressing on a particular type, size, or manufacture of fitting has occurred during a crimp operation, an operator may add an intermediate linking element having a distance of approximately several hundredths of an inch greater between pivot points 94 and 96. The crimp ring segments may include non-adjustable positive stopping apparatus, such as discussed above, which is calibrated for a specific fitting, for example. Thus, by adjusting the relationship of pivot points 94 and 96, interchangeable linking elements 92*a* and 92*b* can be used to fine-tune properties of the crimp made with crimp ring 10.

Figure 4B:
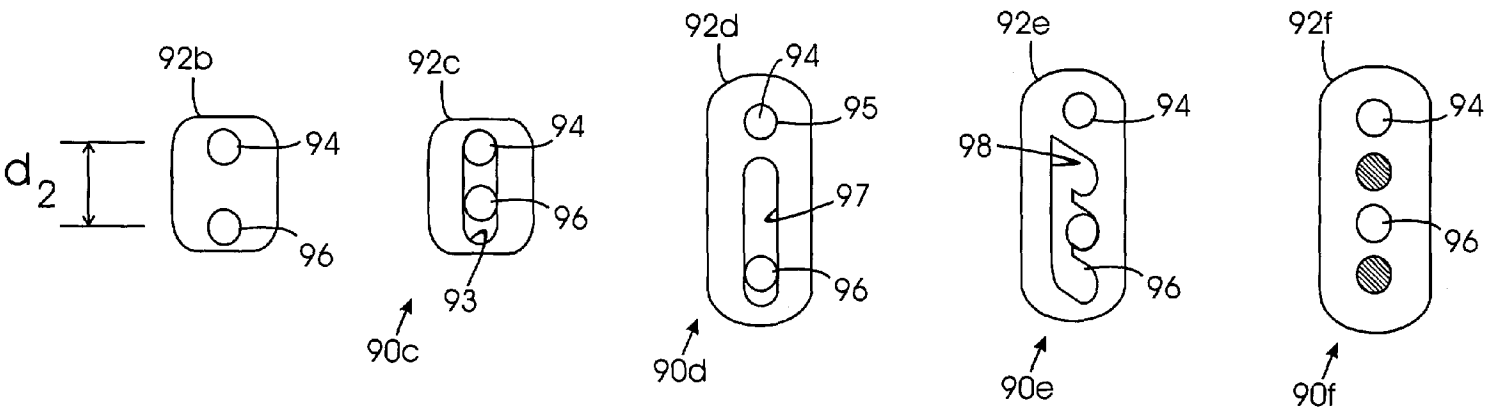

Additional embodiments of linking apparatus 90*c*–*f* are also illustrated in FIG. 4B. For one linking apparatus 90*c*, an intermediate linking element 92*c* defines an elongated aperture 93. First and second pivot pins 94 and 96 are disposed in elongated aperture 93, and each pin 94 and 96 pivotably connects to an ends of a ring segment (not shown). Pivot pins 94 and 96 include adjustable locking mechanisms (not shown) for adjusting and locking their positions in the elongated aperture 93. For example, pivot pins 94 and 96 can each include an adjustable locking mechanism, such as discussed above in the embodiment of FIGS. 3B and 3C.

Another linking apparatus 90*d*, illustrated in FIG. 4B, includes an intermediate linking element 92*d*, which defines a first aperture 95 for pivotably attaching to first pivot pin 94 and first segment 11*a*. First pin 94 is rotatable within first aperture 95. Intermediate linking element 92*d* also defines an elongated aperture 97 for attaching to second pivot pin 96 and second segment 11*b*. Second pivot pin 96 includes an adjustable locking mechanism (not shown) for adjusting and locking its position in the cam aperture 97. For example, second pivot pin 96 can include an adjustable locking mechanism, such as discussed above in the embodiment of FIGS. 3B and 3C.

Other linking apparatus 90*e-f*, illustrated in FIG. 4B, demonstrate linking elements 92*e* or 92*f* defining a plurality of adjustment positions 98 or 99. For example, adjustment positions 98 include a plurality of slots defined in linking element 92*e*. Alternatively, adjustment positions 99 include a plurality of apertures defined in linking element 92*e*. Linking element 92*e* or 92*f* is pivotably attached to first pivot pin 94 disposed on first segment 11*a*. Using the plurality of adjustment positions 98 or 99, linking element 92*e* or 92*f* adjustably and pivotably attaches to second pivot pin 94 disposed on second segment 11*b*. For linking element 92*e*, second pivot pin 96 can include a lock or nut (not shown) to maintain the pin in one of the adjustment slots 98. It should be noted that having the plurality of slots or apertures 98 or 99 of elements 90*e–f* depends on the required diameter for the pins. The construction of elements 90*e–f* as shown may not be possible where larger diameter pins are required.

Figure 5A:
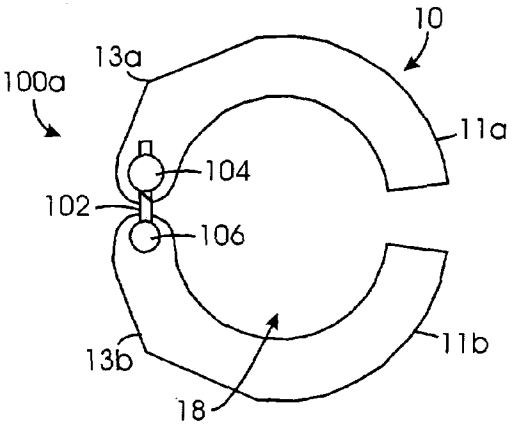
FIGS. 5A–B illustrate embodiments of adjustable pivot connections for a crimp ring according to the present invention.
Figure 5B:
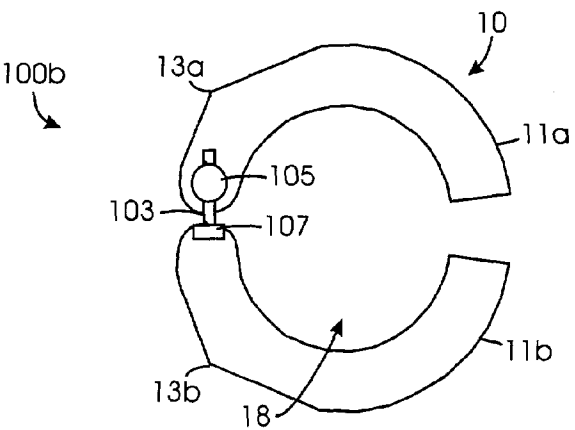

Referring to FIGS. 5A–B, crimp ring 10 includes embodiments of adjustable linking apparatus 100*a* and 100*b*. In FIG. 5A, adjustable linking apparatus 100*a* includes a linking element or threaded extension 102 passing through a trunnion 104, which is pivotably attached to first ring segment 11*a*. Threaded extension 102 is rotatably attached to a pivot pin 106, which is pivotably attached to second segment 11*b*. Rotation of threaded extension 102 causes trunnion pin 104 to move along threaded extension 102 in relation to pivot pin 106. By altering the distance between pivots 104 and 106, crimp dimension 18 defined by the segments can be changed.

Alternatively, each pivot pin pivotably attached to the segments may include trunnions, and ends of threaded extension may have oppositely pitched threads. Rotating the double-pitched extension 102 then moves the two trunnions in relation to one another to change crimp dimension 18 defined by the segments. Adjustable linking apparatus 100*a* provides a cost advantage, because the segments 11*a–b* can be symmetrical, allowing for double production from a single cast design.

In FIG. 5B, adjustable linking apparatus 100*b* includes a threaded extension 103, a trunnion 105, and a fixed notch or nut 107. Trunnion 105 is pivotably attached on first segment 11*a*. Threaded extension 103 is threadably disposed through trunnion 105. A distal end of threaded extension 130 is received in fixed notch 107 attached on second segment 11*b*.

Figure 6:
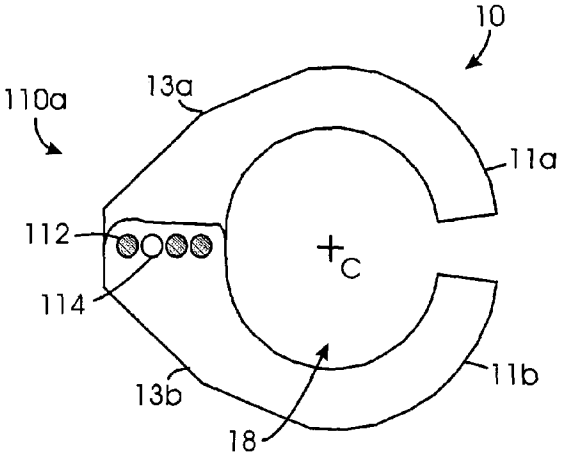
FIG. 6 illustrates another embodiment of an adjustable pivot connection for a crimp ring according to the present invention.

Referring to FIG. 6, an embodiment of an adjustable pivot connection 110 for crimp ring 10 is schematically illustrated. Segments 11*a* and 11*b* each define a plurality of pivot apertures 112. The plurality of pivot apertures 112 lies substantially in line with an approximate center C of crimp opening 18. Pivot apertures 112 in the segments align together when the segments are in a closed position. A pivot pin 114 is adjustably positioned in one of the plurality of pivot apertures 112. By interchanging pivot pin 114 between the apertures 112, an operator alters the pivot connection between segments 11*a* and 11*b*, thereby adjusting properties of the crimp produced on a fitting.

Figure 7:
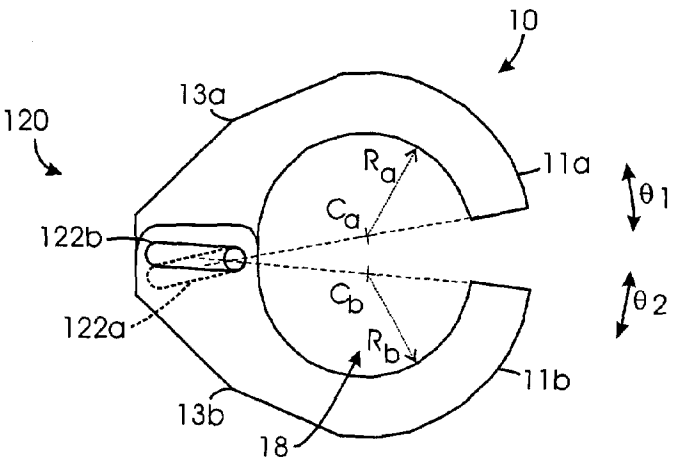
FIG. 7 illustrates yet another embodiment of an adjustable pivot connection for a crimp ring according to the present invention.

Referring to FIG. 7, an embodiment of an adjustable pivot connection 120 is schematically illustrated. First and second segments 11*a* and 11*b* each define an elongated aperture 122*a* and 122*b*. A pivot pin 124 is disposed within elongated apertures 122*a* and 122*b*. Segments 11*a* and 11*b* pivot relative to one another about pin 124. Pin 124 is locked in position in the apertures 122*a* and 122*b* to maintain a specific pivotable relationship between first and second segments 11*a* and 11*b*.

First segment 11*a* has a first crimp radius $R_a$ defined from a first center $C_a$. Elongated aperture 122*a* is aligned with center $C_a$. Likewise, second segment 11*b* has a second crimp radius $R_a$ defined from a second center $C_a$. Elongated aperture 122*b* is aligned with center $C_b$. However, elongated apertures 122*a* and 122*b* can initially be provided with angles at any varying degrees $\theta_1$ and $\theta_2$ relative to centers $C_a$ and $C_b$. Furthermore, elongated apertures 122*a* and 122*b* can have curved or irregular shapes other than the elongated shape illustrated in FIG. 7.

Orientations and shapes of elongated apertures 122*a* and 122*b* can be used to determine the displacement of segments 11*a* and 11*b* in relation to one another and in relation to the fitting as the segments are pivoted about pin 124. The orientations and shapes of elongated apertures 122*a* and 122*b* can therefore alter properties of the crimp produced on a fitting and can be pre-configured to produce an appropriate crimp on the fitting.

Figure 8:
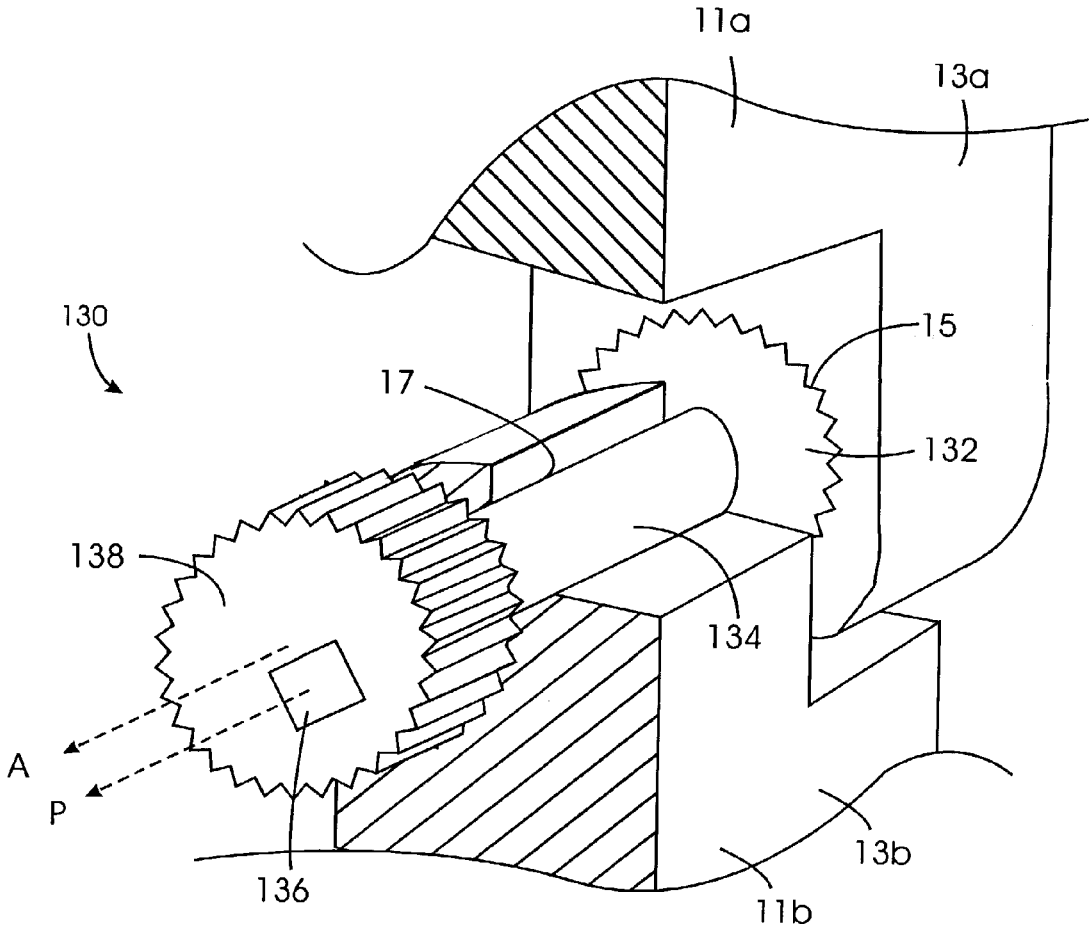

Referring to FIG. 8, crimp ring 10 includes an eccentric pivot apparatus 130. In FIG. 8, a partial perspective view of the pivot connection between segments 11*a* and 11*b* is illustrated. Segments 11*a* and 11*b* are illustrated in cross-section to reveal eccentric pivot apparatus 130 at the pivot connection. First segment 11*a* includes a bifurcate end 13*a* having first and second sides, only one of which is illustrated. The sides define locking apertures 15 having splines. Second segment 11*b* includes an end 13*b* disposed in bifurcate end 13*a* of first segment 11*a*. End 13*b* defines a pivot aperture 17. Eccentric pivot apparatus 130 is disposed in apertures 15 and 17 and forming the pivot connection between adjoined ends 13*a* and 13*b*.

Figure 9A:
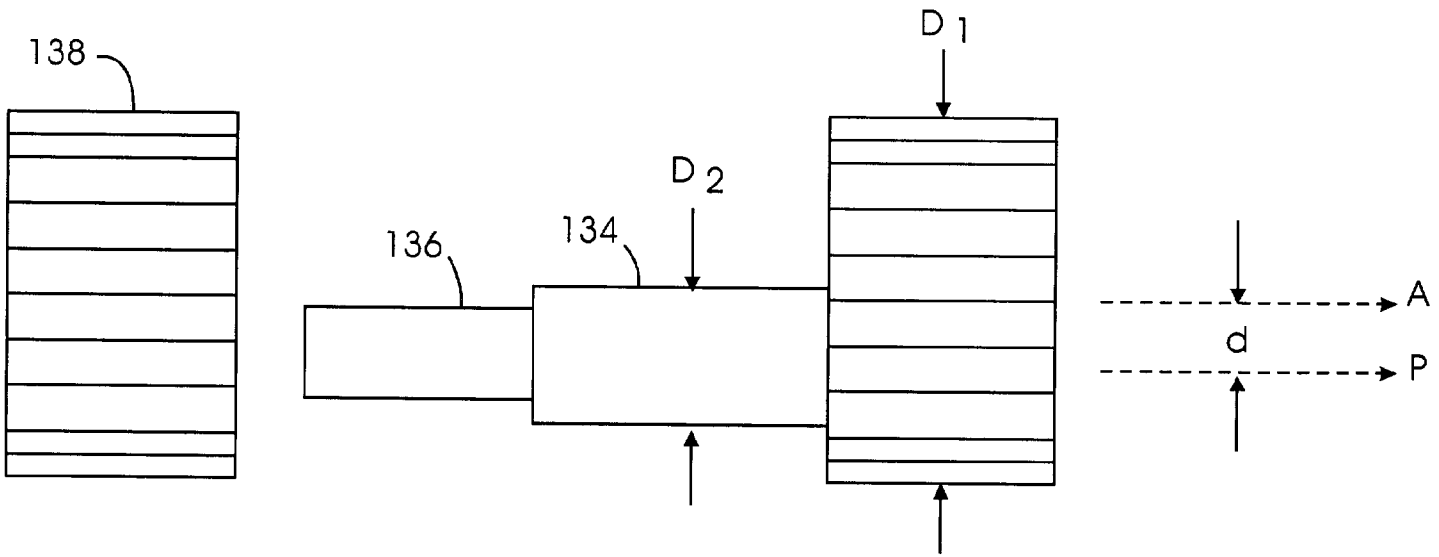
Figure 9B:
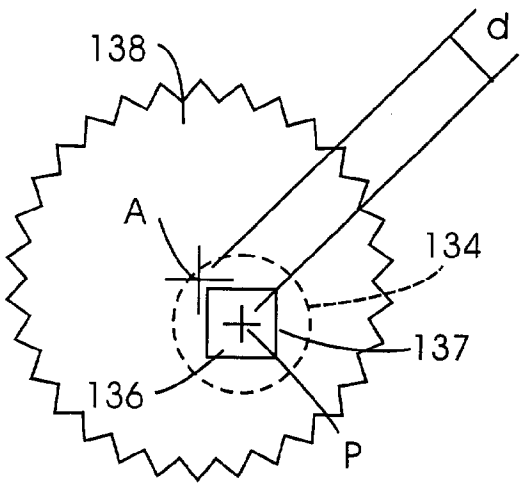

Eccentric pivot apparatus 130, which is shown in relevant detail in FIGS. 9A and 9B, includes a first base 132 and a second base 138. An intermediate pin 134 is connected to first base 132 and extends from one side of first base 132. Pin 134 has an axial center P offset from an axial center A of base 132 by a distance d. A key 136 is formed on a distal end of intermediate pin 134. Key 136 disposes in a keyway 137 defined in second base 138. Keyway 137 is also offset from axial center A of second base 138 by the distance d. The bases 132 and 138 can be connected in parallel and centrally aligned with one another on intermediate pin 134. The bases 132 and 138 have a first diameter $D_1$. The outer surfaces of the bases 132 and 138 include splines, which interlock with the splines of locking apertures 15. Intermediate pin 134 has a second diameter $D_2$ that is less than the first diameter $D_1$. The outer surface of the pin 134 is smooth, allowing the pin to rotate in pivot aperture 17.

When assembled as shown in FIG. 8, first base 132 is disposed in one of the locking apertures 15 of first segment 11*a*. The splines in locking aperture 15 allow the orientation of first base 132 to be locked in place when disposed in locking aperture 15. A retainer (not shown) on the outside of bifurcate end 13*a* may be used to hold first base 132 in locking aperture 15. Intermediate pin 134 is disposed in pivot aperture 17 of second segment 11*b*. Second base 138 is disposed in another locking aperture (not shown) with splines, and key 136 is disposed in keyway 137. Another retainer (not shown) on the outside of bifurcate end 13*a* may be used to hold second base 138.

Second segment 11*b* has an axis of pivot about the axial center P of intermediate pin 134. By removing, rotating, and repositioning bases 132 and 138 in locking apertures 15, the eccentric pivot axis P of second segment 11*b* can be changed relative to first segment 11*a*. Thus, eccentric pivot apparatus 130 provides an adjustable pivot axes P between segments 11*a* and 11*b*. Eccentric pivot apparatus 130 can be used to fine-tune the closure of segments 11*a* and 11*b* about a fitting as discussed below.

In FIGS. 10A and 10B, a side view and end cross-sectional view of eccentric pivot apparatus 130 in a first position are illustrated. In FIGS. 10C and 10D, a side view and end cross-sectional view of eccentric pivot apparatus 130 in a second position are illustrated. As best shown in FIGS. 10A and 10C, pivot axis P can be adjusted in relation to a relative center C of crimp ring 10. For example, axes A of the bases 132 and 138 and pivot axis P of the intermediate pin 134 define a plane X. By removing, rotating, and repositioning bases 132 and 138 in locking apertures 15, the plane X defined by axes A and P may be angled and oriented at varying degrees relative to the center C of segments 11*a* and 11*b*. The splines of bases 132 and 138 and locking apertures 15 allow the axes A and P defining the plane X to be adjusted in small increments.

By adjusting the orientation of plane X, a relative distance D between segments 11*a* and 11*b* can be increased from zero to d. For example, if plane X is angled at 90-degrees relative to center C as shown in FIGS. 10A and 10B, the relative dimension D defined between segments 11*a* and 11*b* is increased by the distance d between the axes A and P. In addition, either segment 11*a* or 11*b* can be positioned closer to the relative center C from 0 to d by adjusting the orientation of plane X. For example, if plane X is angled at 0-degrees relative to center C as shown in FIGS. 10C and 10D, the relative dimension D defined by segments 11*a* and 11*b* is not increased. However, first segment 11*a* is positioned closer to center C than second segment 11*b* by the distance d between axes A and P.

During a crimping operation, the segments 11*a* and 11*b* pivot about intermediate pin 134. Eccentric pivot apparatus 130 allows the orientation of the pivot to be adjusted. Consequently, an operator can adjust eccentric pivot apparatus 130 to alter properties of the crimp produced on a fitting to produce an appropriate crimp on the fitting.

D. Alternative Crimp Ring Construction

Alternate embodiments of crimp ring construction will now be discussed with reference to the drawings. Some embodiments of the crimp rings and the segments disclosed herein may require intricate casting or precise machining to manufacture. Accordingly, in some embodiments of the present invention, the crimp ring may include a laminated structure. For example, embodiments of crimp rings having positive stopping apparatus or adjustable pivot connections may benefit from a laminated structure. In general, however, the laminated structures for crimp rings may be used independently from or in combination with the positive stopping apparatus or the adjustable pivot connections. The laminated structure may include exclusively or in combination stamped, cast, laser cut, water-jet cut, milled, or fine-blanked laminations. Furthermore, inserts may also be included as required to form the crimp ring.

Figure 11A:
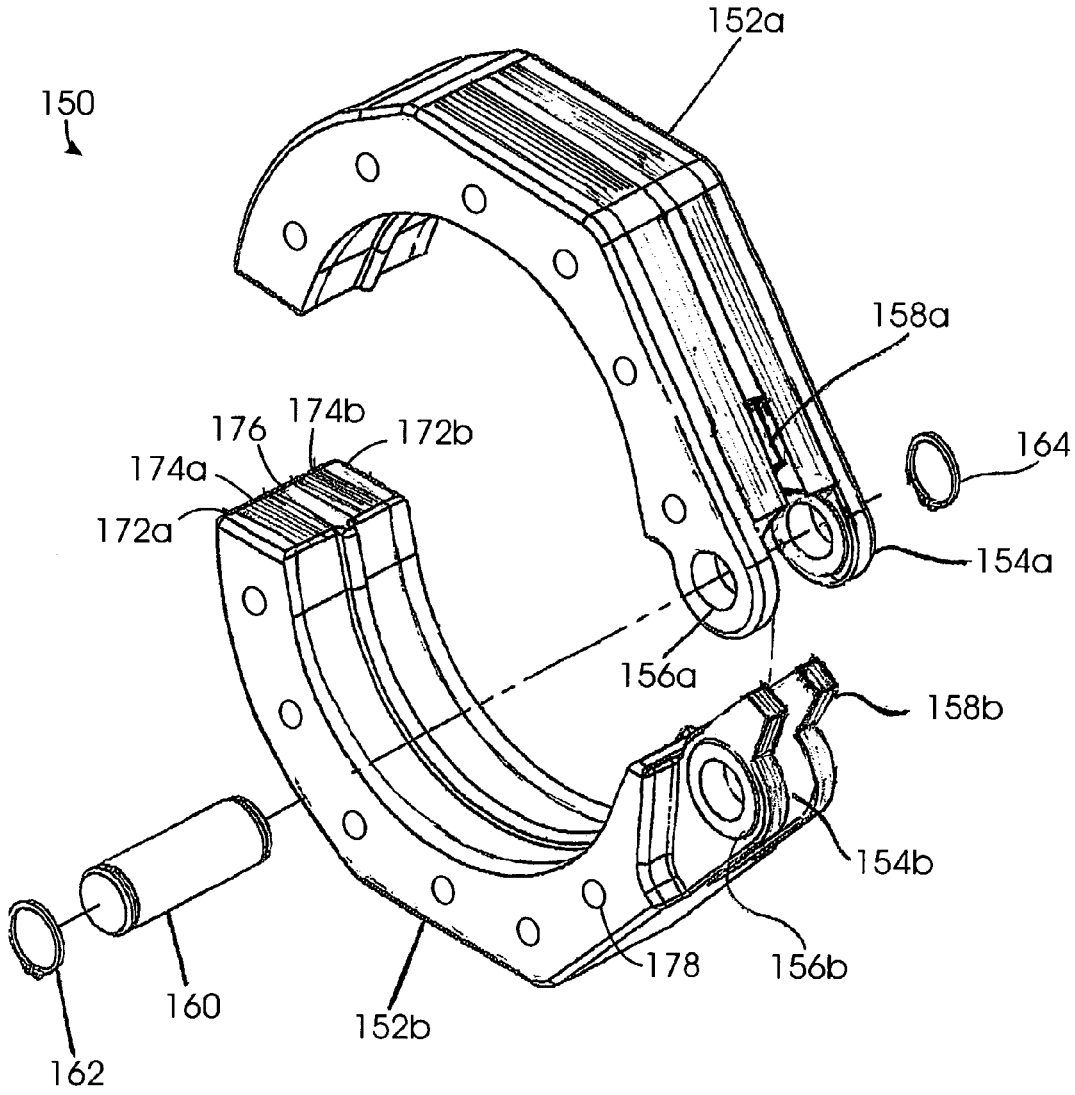
FIG. 11A illustrates an embodiment of a crimp ring with a laminated structure and a positive stopping apparatus according to the present invention.

Referring to FIG. 11A, a crimp ring 150 having a laminated structure in accordance with the present invention is illustrated. Crimp ring 150, shown partially disassembled in FIG. 11A, includes a first segment 152*a*, a second segment 152*b*, and a pivot pin 160. First and second segments 152*a* and 152*b* each include an end 154*a* and 154*b* defining a pivot aperture 156*a* and 156*b*. Ends 154*a* and 154*b* are adjoined, and pivot pin 160 is positioned through apertures 156*a* and 156*b*. Although not shown in FIG. 11A, a torsion spring, which biases segments 152*a–b* open, is positioned within the bifurcate end 154*a* with pivot pin 160 disposed through the torsion spring. External retaining rings 162 and 164 attach to ends of pin 160 to maintain the pin within the pivot apertures. A spacer (not shown), disposed on pin 160, can be used between bifurcate ends 154*a–b* to provide a stable hinged connection.

Each ring segment 152*a* and 152*b* comprises a laminated structure. The laminated structure has, for example, five laminated layers, including a first side lamination 172*a*, a first inner lamination 174*a*, a center lamination 176, a second inner lamination 174*b*, and a second side lamination 172*b*. First and second side laminations 172*a* and 172*b* and center lamination 176 may each be comprised of a single lamination being stamped, cast, or otherwise formed. First and second inner laminations 174*a* and 174*b* may each be fine-blanked and comprised of multiple layers of thin laminates, although inner laminations 174*a* and 174 may each also be comprised of a single lamination. Center lamination 176 preferably includes an extension for alignment.

Relative heights and widths of individual laminations and the overall number of laminations may vary for different sized fittings or crimping patterns to be employed thereon. A plurality of rivets 178 are used to hold the laminations 172*a–b*, 174*a–b*, and 175 together to form the segments 152*a* and 152*b*. Alternatively, the laminations can be held together by other fasteners or by an adhesive. It is understood that the laminations can be held together by a number of other methods known in the art, including, but not limited to, welding and brazing.

Preferably, the laminated structure allows for parts, dimensions, or features of crimp ring 150 requiring key tolerances to be fine-blanked laminations. Less critical parts, dimensions, or features may be stamped or cast laminations. For example, crimp ring 150 with the laminated structure in FIG. 11A includes a positive stopping apparatus. First laminated segment 152*a* includes a first positive stopping surface 158*a* adjacent pivot aperture 156*a*. Second laminated segment 152*b* includes a second positive stopping surface 158*b* adjacent pivot aperture 156*b*. First and second positive stopping surfaces 158*a* and 158*b* are preferably formed with fine-blanked laminations 174*a* and 174*b*. Use of fine-blanked laminations 174*a* and 174*b* facilitates production of positive stopping surfaces 158*a* and 158*b* with a high degree of precision.

In addition to providing a high degree of precision, constructing segments 152*a* and 152*b* and assembling crimp ring 150 with laminations 172*a–b*, 174*a–b*, and 176 is simpler and less costly than casting and machining single piece segments to meet desired tolerances. With the laminated structure, reduced machining may be required to produce the positive stopping apparatus or adjustable pivot connections of the present invention.

Figure 11C:
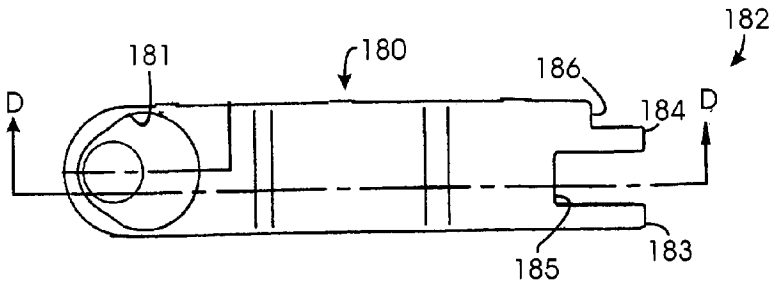
FIGS. 11B–D illustrate various views of an alternative crimp ring according to the present invention.
Figure 11D:
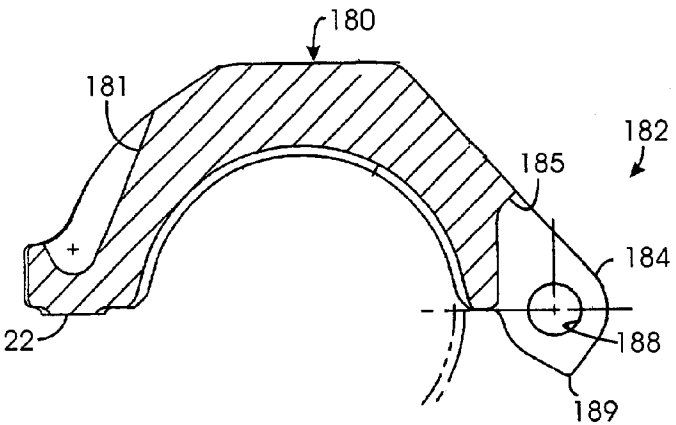
Figure 11B:
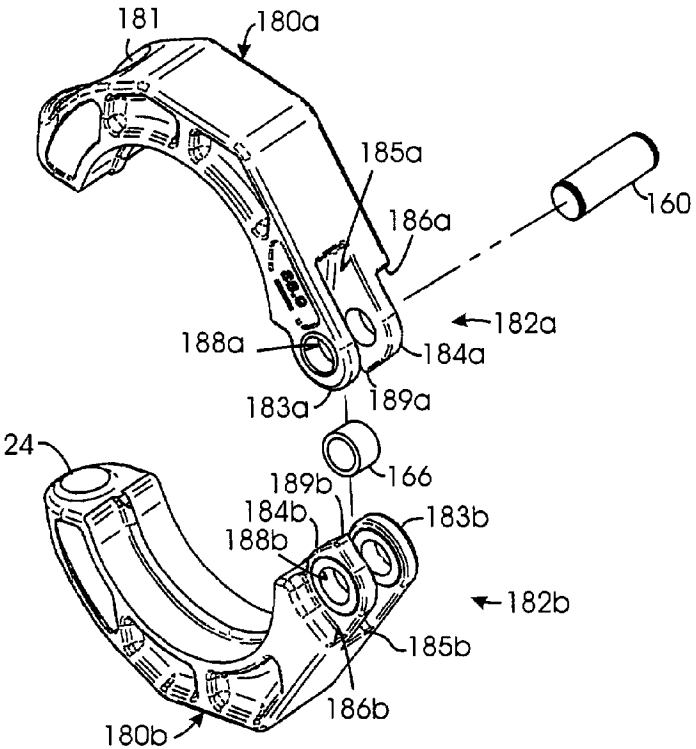

Referring to FIGS. 11B–D, an alternative construction for a crimp ring is illustrated. The crimp ring, shown disassembled in FIG. 11B, is formed with symmetrical segments 180*a–b* connected together with a pivot pin 160. In FIGS. 11C–D, a top view and cross-sectional view of one of the symmetrical segments 180 is illustrated.

First segment 180*a* includes a first bifurcate end 182*a* having a first side 183*a* and a second side 184*a*. End 182*a* also defines a first space 185*a* adjacent second side 184*a* and defines a second space or gap 186*a* between sides 183*a* and 184*a*. The two sides 183*a* and 185*a* define pivot apertures 188*a* for pivot pin 160. Being symmetrical to first segment 180*a*, second segment 180*b* includes a second bifurcate end 182*b* having the same arrangement of sides 183*b*, 184*b* and spaces 185*b*, 186*b*.

To form the crimp ring from the two symmetrical segments 180*a–b*, the bifurcate ends 182*a–b* are adjoined. In particular, first side 183*a* of upper segment 180*a* positions in first space 185*b* of lower segment 180*b* and positions adjacent second side 184*b*. Second side 184*a* of upper segment 180*a* positions in gap 186*b* of lower segment 180*b* and positions between first and second sides 183*b* and 184*b*.

Pivot pin 160 is positioned through pivot apertures 188*a–b*. To improve the hinged connection between ends 182*a–b*, a spacer 166 can be used. For example, spacer 166 is positioned within the bifurcate ends 182*a–b* with pivot pin 160 disposed through an axial bore of the spacer. Although not shown in FIG. 11B, a torsion spring, which biases segments 180*a–b* open, is positioned within the bifurcate ends 182*a–b* with spacer 166 and pivot pin 160 disposed through the torsion spring. External retaining rings (not shown) attach to ends of pin 160 to maintain the pin within the pivot apertures. The second sides 184*a–b* each include an extension 189*a–b*, which engage inner surfaces of the gaps 185*a–b* to limit how far the segments 180*a–b* can open once adjoined. It should be noted that FIG. 11B shows ring segment 180*b* with a positive stop 24 and that FIG. 11D shows ring segment 180*a* with another positive stop 22, such as described above with reference to FIG. 1A. In addition, segments 180*a–b* define pivot ports 181 for articulating on hemispherical ends of actuator arms (not shown).

Figure 11E:
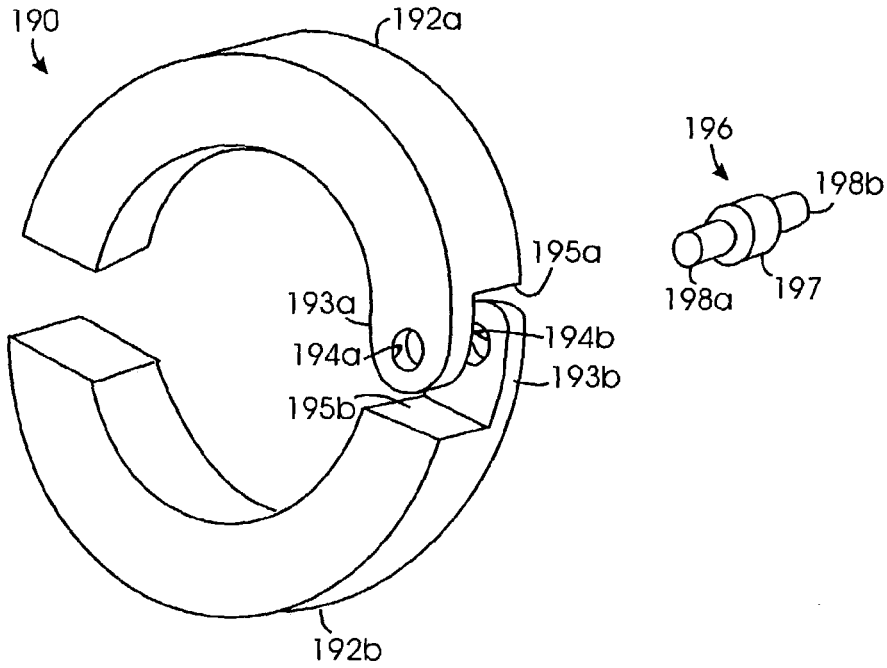
FIGS. 11E–F illustrate various views of another alternative crimp ring according to the present invention
Figure 11F:
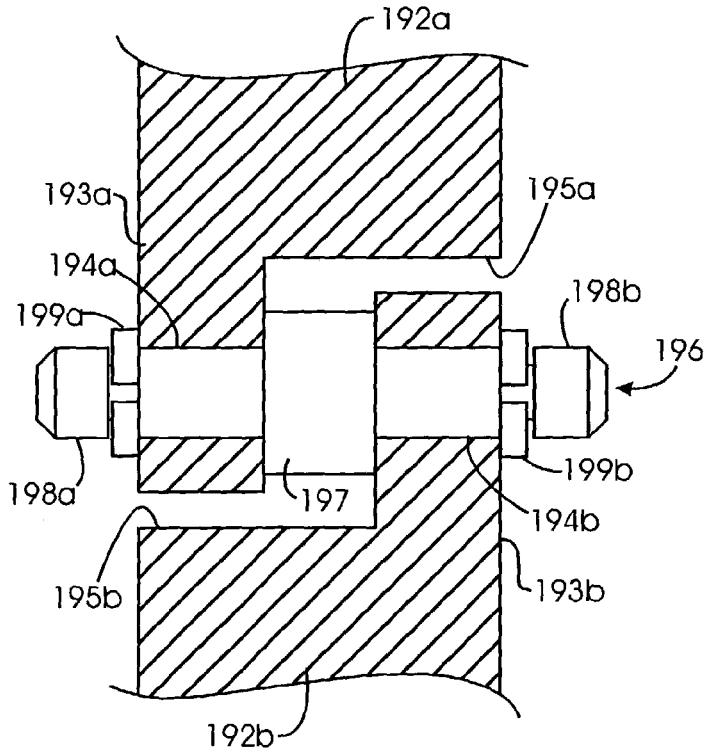

Referring to FIGS. 11E–F, another, alternative construction for a crimp ring 190 is illustrated. Crimp ring 190, shown disassembled in FIG. 11B, is formed with symmetrical segments 190*a–b* connected together with a stepped pin 196. In FIG. 11F, segments 190*a–b* are shown in cross-section connected by stepped pin 196.

In contrast to the embodiment of FIGS. 11B–D, first segment 192*a* includes one ear 193*a* at an end of the segment. A pivot aperture 194*a* is defined in ear 193*a*. Next to ear 193*a*, first segment 192*a* defines a ledge or space 195*a*. Being symmetrical to first segment 192*a*, second segment 192*b* includes an ear 193*b* on one end. A pivot aperture 194*b* is defined in ear 193*b*. Next to ear 193*b*, second segment 192*b* defines a ledge 195*b*. Stepped pin 196 is used to hingedly connect segments 192*a–b*. In contrast to the embodiment of FIGS. 11B–D, stepped pin 196 has a spacer portion 197 integrally formed with first and second pin portions 198*a–b*. Spacer portion 197 has a larger diameter than pin portions 198*a–b* so that a shoulder is formed on both end of stepped pin 196.

To form the crimp ring from the two symmetrical segments 192*a–b*, ear 193*a* is positioned on pin portion 198*a* of stepped pin 196, and ear 193*b* is positioned on pin portion 198*b*, as best shown in FIG. 11F. Ears 193*a–b* are positioned against the shoulders formed by spacer portion 197. Spacer portion 197 separates ears 193*a–b* at an appropriate distance and provides a perpendicular surface that guides segments 192*a–b* when pivoted. Although not shown in FIGS. 11E–F, a torsion spring, which biases segments 192*a–b* closed, is positioned between ears 193*a–b* and disposed on spacer portion 197. Preferably, the width of the spacer portion 197 is no more than in necessary to fit the torsion spring thereon. External retaining rings 199*a–b* attach to ends of pin portions 198*a–b* 160 to maintain ears 193*a–b* thereon and to sustain the hinged connection.

Figure 12A:
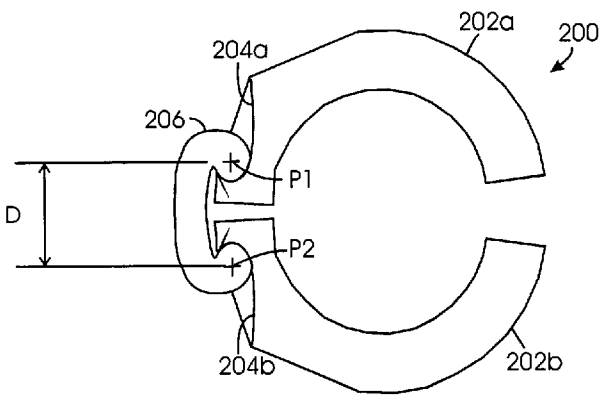
FIGS. 12A–G illustrate embodiments of crimp rings with interlocking ends according to the present invention.

Referring to FIGS. 12A–G, embodiments of crimp rings with interlocking ends according to the present invention will now be discussed. Referring first to FIG. 12A, a first embodiment of a crimp ring 200 is illustrated. Crimp ring 200 includes first and second segments 202*a* and 202*b*, although it is understood that the use of more segments is also possible. In contrast to previous embodiments, crimp ring 200 lacks a pivot pin structure to form the pivot connection between segments 202*a* and 202*b*.

First and second segments 202*a* and 202*b* are symmetrical and are positioned side to side to form the crimp ring 200. Segments 202*a* and 202*b* define wells 204*a* and 204*b*. Ends of a C-clip 206 are disposed in the wells 204*a* and 204*b*. Segments 202*a* and 202*b* are pivotable on the ends of C-clip 206. Structures (not shown) on C-clip 206 or segments 202*a* and 202*b* can be used to keep the segments aligned.

In one embodiment, the ends of C-clip 206 define a radius, and the surfaces of the wells 204*a* and 204*b* engaging the ends of the C-clip also define the radius. The segments 202*a* and 202*b* rotate about the centers of these radii. In this way, first segment 202*a* pivots about a pivot point $P_1$, and second segment 202*b* pivots about a pivot point $P_2$. The pivot points $P_1$ and $P_2$ are separated by a distance d. C-clip 206 can be interchanged with another clip having a different distance between the ends to adjust the pivot points of the segments, thereby adjusting properties of the crimp produced with crimp ring 200.

Figure 12B:
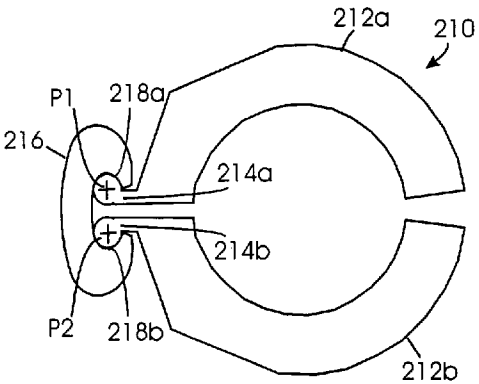

In FIG. 12B, a crimp ring 210 includes a first segments 212*a* and a second segment 212*b*, which are symmetrical and positioned side to side to form the crimp ring 210. Segments 212*a* and 212*b* each include an extension 214*a* and 214*b* with a bulbous or rounded end. Hooked surfaces 218*a–b* of a C-clip 216 position on the ends of extension 214*a* and 214*b*. Segments 202*a* and 202*b* are pivotable on the ends of extension 214*a* and 214*b* in the hooked surfaces of C-clip 206. Segments 202*a* and 202*b* pivot about different pivot points $P_1$ and $P_2$ separated by a distance d. The C-clip 216 can be interchanged with another clip having a different distance between hooked surfaces 218*a* and 218*b* to adjust the distance between pivot points $P_1$ and $P_2$ of the segments, thereby adjusting properties of the crimp produced with crimp ring 200.

Figure 12C:
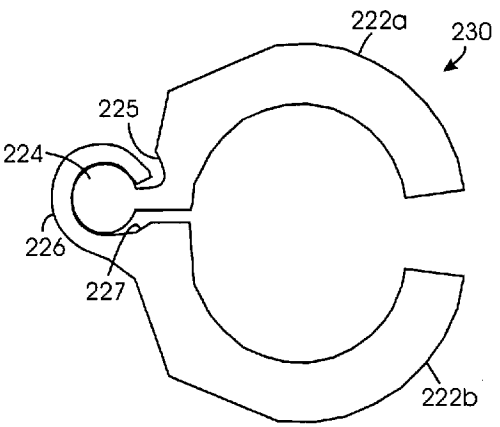

Referring to FIGS. 12C–G, crimp ring assemblies are illustrated, which eliminate the need for a separate pivot pin. In FIG. 12C, a crimp ring 220 includes a first segment 222*a* and a second segment 222*b*. The first segment 222*a* has a bulbous or rounded extension 224. Second segment 222*b* includes a hooked extension 226. The rounded extension 224 is disposed in the hooked extension 226. Rounded extension 224 is rotatable on a surface 227 of hooked extension 226, allowing segment 222*a* to pivot relative to segment 222*b*. First segment 224 preferably defines a space 225 for providing sufficient room for the end of hooked extension 226 when the segments are opened and for stopping the segments from opening beyond a certain point.

Figure 12D:
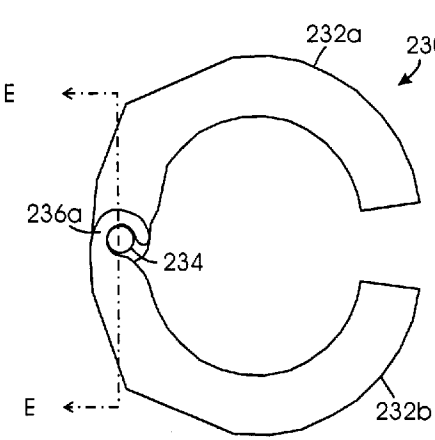
Figure 12E:
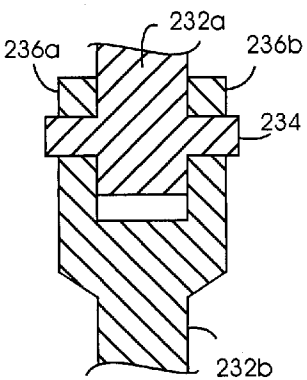

In FIGS. 12D and 12E, a crimp ring 230 includes a first segment 232*a* and a second segment 232*b*. First segment 232*a* has a pin 234, which can be integrally cast thereon, machined, or affixed by a number of methods known in the art. Second segment 222*b* has a hook 236, which can be integrally cast or machined thereon. The hook 236 disposes on pin 234, allowing segment 222*a* to pivot relative to segment 222*b*.

Figure 12F:
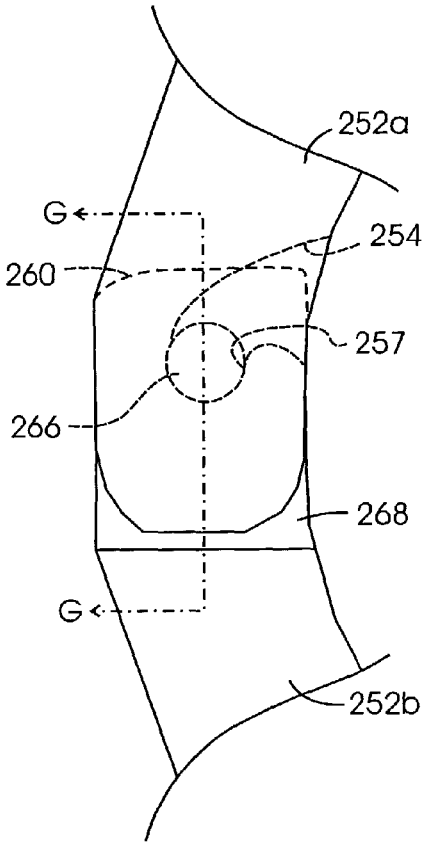
Figure 12G:
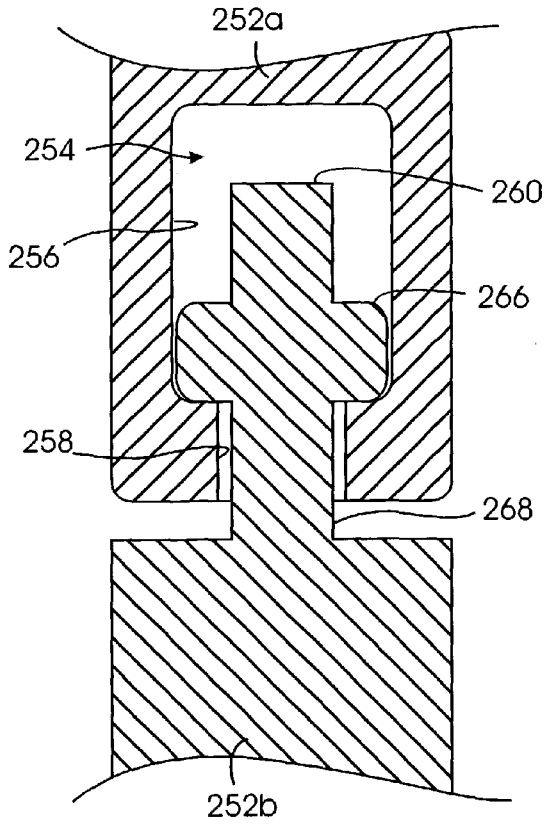

In FIGS. 12F and 12G, a crimp ring 250 includes a first segment 252*a* and a second segment 252*b*, which are only partially shown. First segment 252*a* defines a female feature or hooked pocket 254, which can be integrally cast or machined therein. Second segment 222*b* has a male feature 260 with a catch or cross member 266, which can be integrally cast or machined on the second segment. Male feature 260 couples with female feature 254 by positioning cross member 266 through a widened portion 256 of hooked pocket 254 and engaging cross member 266 in a hook 257 of pocket 254. A portion 268 of male feature 260 passes through a slot 258 in first segment 252*a*.

E. Positive Stopping Apparatus on Actuator Arms or Crimp Jaws

In accordance with the present invention, non-adjustable/adjustable positive stopping apparatus can also be provided on crimp jaws for crimping a fitting or on actuator arms for actuating a crimp ring. These positive stopping apparatus can be used in combination with or independent from any positive stopping apparatus on crimp rings disclosed herein.

Referring to FIGS. 13A–E, adjustable and non-adjustable positive stopping apparatus for an assembly 300 are illustrated. Assembly 300 includes first and second arms 302*a* and 302*b* symmetrically arranged in the assembly. Each of the first and second arms 302*a* and 302*b* includes a pivot point 304*a* and 304*b*, a cam portion 306*a* and 306*b*. Pivot pins (not shown) are disposed in pivot points 304*a* and 304*b* and connect to side plates (not shown) to complete the assembly. Rollers within a crimping tool (not shown) contact cam portions 306*a* and 306*b* of jaws 302*a* and 302*b* causing them to pivot about pivot points 304*a* and 304*b*. The completion of the crimp cycle occurs as tips 309*a* and 309*b* are brought together.

In FIG. 13A, an existing example of a positive stopping apparatus 310 for crimp arms 302*a* and 302*b* includes a positive stop or boss 312. Positive stop or boss 312 may be disposed on a tip 309 of one or both arms 302. Boss 312 may be integrally cast with arm 302 and machined to provide appropriate tolerances for the closure of jaw portions 308*a* and 308*b* about a fitting disposed therebetween.

In FIG. 13B, another example of a positive stopping apparatus 320 includes an adjustable or threaded member 322. Adjustable or threaded member 322 may be disposed on a tip 309*a* of arm 302*a*. Adjustable or threaded member 322 may be adjusted to change the point of engagement with tip 309*b* of adjacent arm 302*b* and provide appropriate tolerances for the closure of jaw portions 308*a* and 308*b* about the fitting disposed therebetween.

In FIGS. 13C–E, the positive stopping apparatus discussed below can be used with assembly 300 having jaw portions that directly contact and crimp the fitting. In addition, the positive stopping apparatus discussed below can be used on actuator arms in an assembly that actuates a crimp ring (not shown).

In FIG. 13C, yet another example of a positive stopping apparatus 330 is illustrated. First arm 302*a* includes a first positive stopping surface 332, and second arm 302*b* includes a second positive stopping surface 334. As arm 302*a* and 302*b* are pivoted together to crimp a fitting or to actuate a crimp ring, first and second positive stopping surfaces 332 and 334 engage one another, defining an end point to the crimping motion of assembly 300. First and second positive stopping surfaces 332 and 334 may be premachined and calibrated to provide an appropriate crimp for a specific fitting or fitting size.

Alternatively, as illustrated in FIG. 13D, at least one of the positive stops on one of the arms may be adjustable. As shown here, first positive stop 342 includes an adjustable or threaded member 344 disposed in first arm 302*a*. The position of adjustable member 344 may be changed to fine tune its engagement with second, fixed positive stopping surface 346 on second arm 302*b*.

As shown in FIGS. 13A–D, positive stopping apparatus may be disposed in or between the arms. In an alternative design illustrated in FIG. 13E, a positive stopping apparatus 350 may be disposed outside the arms of assembly 300. An extension 352 on the side of first arm 302*a* includes a threaded bore with an adjustable member 354 disposed therein. An extension 356 on the side of second arm 302*b* defines a positive stopping surface 356. Engagement of adjustable member 354 and positive stopping surface 356 may be changed by adjusting member 354 within the bore of extension 352.

II. Sensing Systems for Assuring or Determining Appropriate Closure of a Crimp Ring Assembly About a Fitting A. Sensing Apparatus for a Crimp Ring Assembly Referring to FIGS. 14A–D, wherein the same reference numbers indicate like elements between Figures, sensing apparatus and systems for assuring or determining appropriate closure of a crimp ring are shown. The sensing apparatus can be used in combination with or independently from the various positive stopping apparatus, adjustable pivot connections, laminated structures, etc. disclosed herein.

The sensing apparatus include one or more sensors or transducers. The sensors can be positioned on either a crimp ring, actuator arms, or crimp jaws. The sensors can communicate with a number of devices for assessing, assuring, or determining an appropriate crimp on a fitting. The devices can include, but are not limited to, an indicator, a control device, a release mechanism, or a locking mechanism. In the embodiments of sensing apparatus disclosed below, the sensors or transducers can include all desirably applicable sensors known in the art for sensing or indicating. Various sensors based on the principles of induction, eddy current, capacitance, magnetism, or resistance can be used. In addition, optical sensors, pressure sensors, or travel sensors can also be used. Moreover, mechanical switches triggering an electric or visual signal can also be used with sensing apparatus according to the present invention.

Figure 14A:
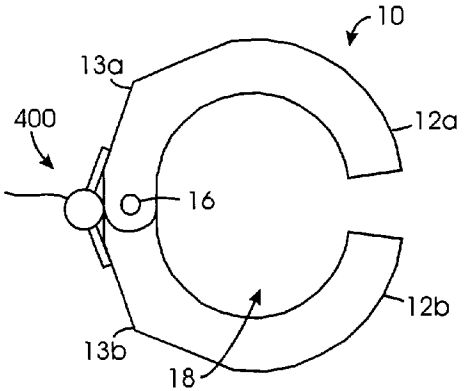
FIGS. 14A–D illustrate embodiments of sensing apparatus for crimp rings according to the present invention.
Figure 14B:
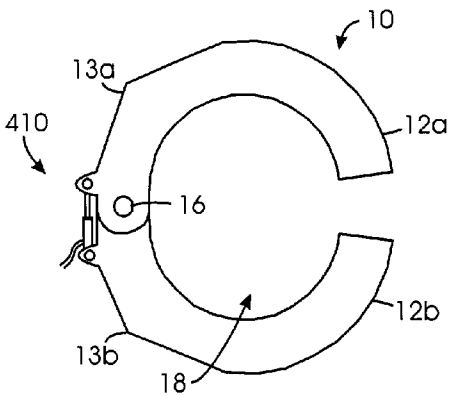

Referring to FIGS. 14A–B, crimp ring 10 includes sensors 400 and 410 at pivot point 16 to measure annular movement of ring segments 11*a* and 11*b*. In one embodiment illustrated in FIG. 4A, sensor 400 is a rotary displacement sensor, such as a potentiometer or rotary capacitive displacement transducer, or is a rotary position encoder disposed adjacent pivot 16 and outside crimp ring 10. Sensor 400 is attached to segments 11*a* and 11*b*. Sensor 400 measures the angular relation between the segments by producing varied resistances or capacitance at different angular orientations of the segments.

A signal from sensor 400 is transmitted to a device (not shown) to indicate the angular relation of the segments. Transmission of the signal from the sensor 400 can include a number of techniques and methods known in the art. In one example, the signal can be transmitted via UHF, VHF, or 900 MHz radio waves. The device can use the angular relation to assure or determine appropriate closure of the crimp ring. In other words, the device can be a release mechanism that electrically stops the crimping tool during the crimp operation once a predetermined resistance or capacitance level is reached by sensor 400.

In addition, sensor 400 can be used in concert with a microcontroller (not shown). Processing the signal, the microcontroller can correlate the angular position of ring segments 13*a* and 13*b* with other measured parameters of the crimp tool, such as ram force to produce a fault signal. For example, the microcontroller can produce an audible alarm, if the proper angular signal is not detected in sensor 400 when a ram force sensor in the tool indicates that a preset value has not been attained, such as 32 kN.

In another embodiment illustrated in FIG. 14B, sensor 410 is a linear sensor attached to first and second segments 11*a* and 11*b* adjacent pivot 16. For example, sensor 410 can be a linear variable differential transformer (LVDT) with each end attached to segments 11*a* and 11*b*. Pivoting of segments 11*a* and 11*b* in relation to one another alters the distance between points on the segments and changes the voltage output of sensor 410. The signal from sensor 410 is communicated to a device (not shown) to indicate the angular relation of segments 11*a* and 11*b*. The device can use the angular relation to electrically stop a crimping tool during a crimp operation once a predetermined voltage level is output by gauge 410.

Figure 14C:
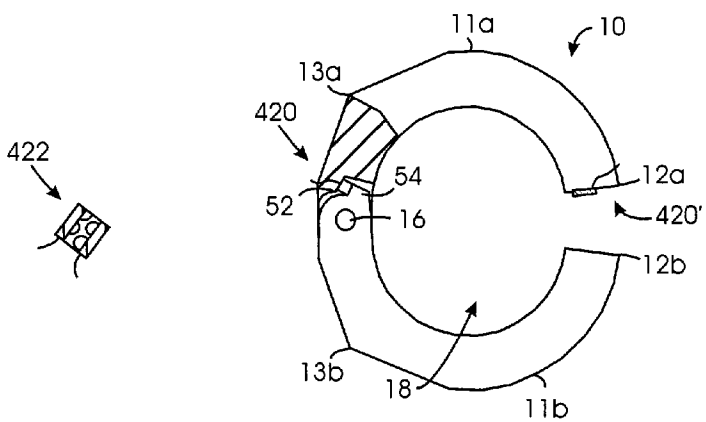
Figure 14D:
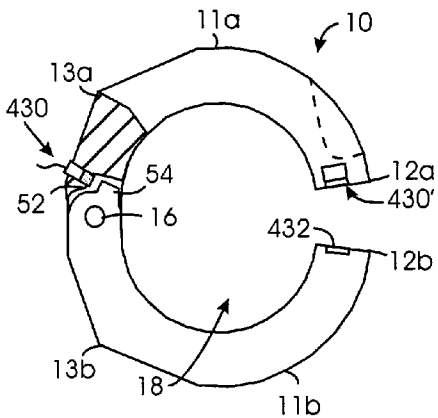

Referring to FIGS. 14C–D, crimp ring 10 includes sensors 420 and 430 for sensing contact of positive stops or for measuring the proximity of ring segments 11*a* and 11*b*. Sensors 420 or 430 can be, for example, piezoelectric elements, pressure sensitive elements, or proximity sensors. With reference to FIG. 14C, a proximity sensor, strain gauge, or load cell 420 is disposed on a first positive stopping surface 52 adjacent pivot point 16. A second positive stopping surface 54 on second segment 11*a* engages contact sensing element 420 as segments 11*a* and 11*b* are brought together. The angular relation of segments 11*a* and 11*b* may be measured by the voltage generated by contact sensing element 420. In an alternative arrangement, a contact sensing element 420' can be attached to free end 12*a* of first segment 11*a*. This contact sensing element 420' engages free end 12*b* of second segment 12*b* as crimp ring 10 is closed. At least one of the free ends 12*a* and 12*b* includes an adjustable stop to change the point of engagement and indication of the element.

In FIG. 14C, a pressure sensitive element or switch 422 can be disposed between first and second positive stopping surfaces 52 and 54 adjacent pivot point 16 of the first and second segments. Pressure sensitive element 422, such as a capacitive displacement linear position sensor, for example, includes a first conductive plate affixing to first positive stopping surface 54 and includes a second conductive plate affixing to second positive stopping surface 54. A non-conductive material, such as foam, is disposed between the first and second plates.

The plates are connected to additional electronics to measure their proximity to one another, which is proportional to the capacitive signal. Pressure sensitive element 422 acts as a switch as the first and second plates are moved closer to each other. At a predetermined or calibrated distance, capacitance is measured from one plate to the other indicating a completed, pre-determined closure of the segments. The indication from pressure sensitive element 422 can be used to shut off a crimping tool at a specified dimension to assure an appropriate crimp of the fitting or else send an alarm if the proper closure is not attained during the crimp cycle.

As shown in FIG. 14D, a proximity sensor or switch 430 is disposed in end 13*a* of first segment 11*a*. Proximity sensor 430, which can be, for example, inductive or capacitive, is used to measure the distance to a positive stopping surface 54 defined in end 13*b* of second segment 11*b*. By measuring the distance, the angular relation of segments 11*a* and 11*b* can be determined. Alternatively, proximity sensor 430 can be used to indicate when a predetermined distance is reached from positive stopping surface 54.

Instead of being disposed on end 13*b*, a proximity sensor 430' can be disposed on free end 12*a* of first segment 11*a*. Proximity sensor 430' can be used to indicate when a predetermined distance is reached between ends 12*a* and 12*b* as the crimp ring is closed. Furthermore, an additional element 432 can be positioned on free end 12*b* of second segment 12*b* and can act as a relational point for proximity sensor 430'. For example, additional element 432 can be composed of a material or metal with a dielectric constant other than that used in segments 11*a* and 11*b*. In this way, proximity sensor 430 can be designed or calibrated to be more sensitive to the particular material of additional element 432.

B. Sensing Apparatus for Actuator Arms or Crimp Jaws

In further embodiments of sensing apparatus, the present invention may include apparatus for assuring/determining appropriate closure of arms of an actuator assembly or jaws of a crimp assembly. The arms of the actuator assembly actuate a ring or chain to crimp the fitting. The jaws of the crimp assembly are used to directly crimp a fitting. Transducers or sensors, such as those discussed above for use with the crimp ring, can be used with the arms or jaws and positive stopping apparatus to assure or determine an appropriate point of closure.

III. Diagnostics and Analysis

Once the sensors or transducers are engaged or triggered, data from the sensing systems is used to analyze and diagnose the crimp produced during the crimp operation. The analysis and diagnosis, in turn, is used to recalibrate or fine tune the adjustable positive stopping apparatus on the crimp ring, arms, or jaws to improve the crimp produced on the fittings. In addition, the analysis and diagnosis is used to adjust the adjustable pivot connection between the segments of the crimp ring to improve the crimp produced on the fittings.

Figure 15:
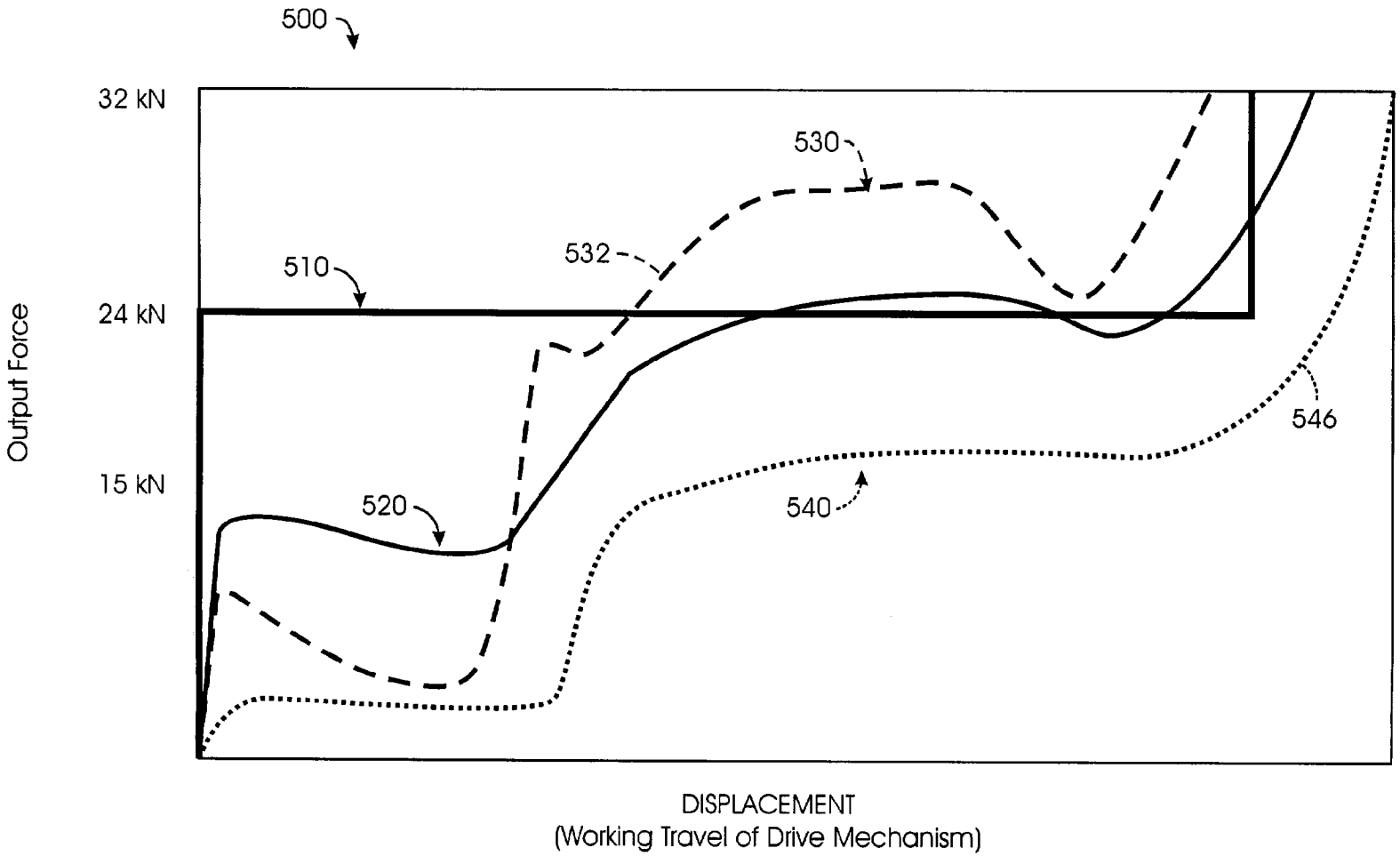
FIG. 15 illustrates a graph of force versus displacement profiles according to the present invention.

Referring to FIG. 15, exemplary force versus displacement profiles are schematically illustrated for crimping a fitting with a crimp ring. On the graph, the vertical axis denotes the output force, and the horizontal axis denotes the displacement of the actuating mechanism, such as a hydraulic piston or driven rod. As noted above, a typical crimping tool has a maximum output force at which the tool shuts off. A release mechanism may be used to shut-off the tool when the maximum output force is reached. For example, a typical crimping tool may have a maximum hydraulic output of about 32 kN at which point the tool shuts off.

An ideal force versus displacement curve 510 is illustrated. The area under the curves represents the amount of work used to produce a crimp on a fitting. As noted above, for a given fitting used to join pipes, variations may unfortunately exist in the crimping operation due to differences in materials, wall thickness, elasticity of the crimping tool, differences in manufacturing tolerances, heat expansion, etc. Curve 520 schematically shows a more realistic, nearly ideal force versus displacement profile.

Output force is measured from the drive mechanism during the crimping operation. When measured from the drive mechanism, the output force is directly related to actual forces applied to a fitting with crimp jaws or a crimp ring, but it is understood that the output force is less than the actual crimping forces applied to the fitting. Fluctuations in the output forces measured in the graph result from changes in resistance and deformation of the fitting, pipe, actuator arms, crimp jaws and/or crimp ring during the crimp operation. Such force profile data is useful in adjusting, selecting, or calibrating the crimp ring, arms, or jaws to improve the crimp produced on a given fitting. The adjustment, selection, or calibration is made to account for variations in a given fitting, wear of the tool, differing tolerances, etc.

FIG. 15 also includes curves 530 and 540 with deviations of the output force that produce less than ideal crimps on a given fitting. For example, curve 530 is characteristic of crimping a given fitting with a crimp ring or crimp jaws defining an inner dimension that is too small for the fitting, resulting in over-pressing of the fitting. Due to over-pressing, the force increases and departs from the ideal or near ideal profiles 510 and 520. Force profile 530 prematurely peeks higher than is ideally desirable when crimping the fitting. This premature peaking can cause the tool to shut off before a completed crimp is formed, if the hump in curve 530 climbs above 32 kN before the appropriate displacement is attained.

In addition, a sustained portion 532 of force profile 530 can in general have a higher force than is desirable when crimping the fitting. In such a situation, more work is used than is necessary to crimp the fitting. The peaking and large output force indicate to an operator that adjustment of the pivot point or the positive stopping apparatus of the crimp ring is necessary to reduce over-pressing the slightly larger fitting with the crimp ring or jaws. When used in combination with other aspects of the present invention, the crimp ring, actuator arms, or jaws can be adjusted, selected, or calibrated to improve the crimp produced on the given fitting based on force profile 530.

Curve 540 results from crimping the given fitting with a crimp ring, chain, or jaws that define an inner dimension that is too large for the fitting. Resistance from the fitting against the ring, chain, or jaws is low, and the output force remains low. A ramp portion 546 of the force profile 540 extends for a longer displacement of the drive mechanism than is desirable when crimping the fitting. Preferably, the force ramps rapidly to the shut-off force in a shorter portion of the drive mechanism's stroke. When used in combination with other aspects of the present invention, the crimp ring, actuator arms, or crimp jaws can be adjusted, selected, or calibrated to improve the crimp produced on the given fitting based on such a force profile 540.

As illustrated in FIG. 15, the crimping tool can have a maximum force output of about 32 kN, at which point the tool is shut off. Use of positive stopping apparatus as disclosed above can advantageously act in conjunction with the conventional tool shut-off mechanisms known in the art. The positive stopping apparatus of the present invention can be pre-calibrated or adjusted to produce a ramping portion of the force during the crimp operation. This ramping of the force can be used to rapidly reach the tool shut-off force, as desired to produce an appropriate crimp on the fitting.

It may be useful to monitor the time of a crimp operation and to measure distance between the actuator arms or jaws on the tool. In other words, it is useful to monitor contact between the correct elements at the correct time. However, the present preference is to monitor the position or displacement of the tool and the force applied rather than time.

The force verses displacement of a crimp operation is time independent and is highly repeatable. However, the force versus displacement of a crimp operation is different for each sized fitting. Therefore, a start position of the crimp operation can be used in combination with a position at a mechanical positive stop to access an appropriate crimp. The use of a sensor with the mechanical positive stop helps to confirm when the pre-calibrated or adjustable stop is reached. The sensor can then turn off the tool, allowing for confirmation of adequate force without over-stressing the crimping tool, the jaws, the actuator arms, or the crimp ring.

In some embodiments of the present invention, the sensors on the crimp ring, actuator arms, or crimp jaws can actively transmit to the tool. For example, the sensors on the crimp ring or jaws can transmit radio frequencies or wireless signals to a processor or control device in the crimping tool or in a remote unit. On the other hand, a diagnostic telemeter, indicator, or controller can be included on the crimp ring, actuator, or jaws.

For example, a diagnostic telemetry device can be embedded in the crimp ring. The telemetry device can measure the relative distance of one ring segment in relation to another. Alternatively, the telemetry device can measure the pressure produced on the inner surface of one or more of the segments during a crimp operation. In addition, the telemetry device can be used to measure physical characteristics of the segments or fitting, such as temperature, strain, etc. The measured distance, pressure, or other data can then be sent to a control device, assessment device, or indicator on the crimping tool or a separate unit.

The telemetry device can include a transmitter using UHF, VHF, or 900 MHz. For example, radio frequencies from the transmitter can carry the data to a receiver in the control device. The control device can use the telemetric data to indicate or record the crimp operation. The data can further be processed and used in diagnosing the crimp produced on the fitting.

In one embodiment of the present invention, a control or assessment device acts in conjunction with the sensors and the positive stopping apparatus or the adjustable/cam operating pivot connections as discussed above. When the ring segment, actuator arms, or jaws are in an open position, the positive stopping surface is calibrated not to trigger or engage the sensor. Contact or activation occurs between the sensor and the positive stop at final closed position, creating a signal that is processed in the control or assessment device.

The control or assessment device can include a microprocessor, software, receiver, transmitter, or additional hardware and electronics. Specific specifications can be input or communicated to the control or assessment device, including the type and or size of the fitting to be crimped, the crimping ring to be used, and the tool to be used. In addition, the control or assessment device can include programming for an operator to manually set boundary conditions for the crimp operation.

The control or assessment device stores force versus displacement profiles. The stored profiles, such as the characteristic or near ideal curve 520 in FIG. 15, are used in analyzing and processing signals, measurements, or data from the crimp ring, the jaws, or the tool during the crimp operation. The signals, measurements, or data are compared to the stored profiles to determine the likelihood of a proper crimp. It is understood that the profiles include a range or band of appropriate tolerances for the data. The profiles can be stored in the form of functions or as sets of points. Each profile can be specific for a certain crimping tool, actuator, jaws, crimp ring, and/or fitting. When a certain tool, actuator, jaws, ring, and/or fitting are to be used, the appropriate force versus displacement profile can then be selected.

From the sensors as discussed above, signals corresponding to the output force, the displacement, the contact of the positive stopping apparatus, or the measurements of the sensor are sent to the control or assessment device, which processes these signals. The control or assessment device compares data or measurements of the signal to the profile for the selected crimping tool, actuator, jaws, crimp ring, and/or fitting. A check is made as to whether the values lie within limits of the stored profile. The comparison is used to determine whether a malfunction is present. For example, the malfunction may be due to the pressing of a fitting of incorrect size, a pipe end that is not pushed completely into the fitting, or a jam due to trapped foreign objects or creasing at the fitting. The control or assessment device indicates the malfunction or shuts down the crimping tool during the operation.

The signals, measurements, or data can undergo a mapping analysis of the force versus displacement. Divergence in the force/displacement profiles or rapid changes in the same during a crimp operation can be used as indicia of fatigue, cracking, breakage, malfunction, under-pressing, over-pressing, or stressing, etc. of the crimp ring, crimp ring actuator, crimp jaw assembly, or tool. In addition, divergence in force/displacement profiles or rapid changes in the same can indicate that the crimp ring is not properly sized or that the stopped distance between closed crimp jaws is incorrect, etc. With such an analysis, a positive stop or an adjustable crimp ring can be adjusted or fine-tuned to improve the crimp operation. By adjusting the stop of the crimp operation or the pivoting of the ring segments, more appropriate force versus displacement profiles can be produced. The sensing can also determine if there an obstruction is limiting travel of the crimp rings or jaws to prevent proper closure.

As used in the present disclosure and in the appended claims, a crimping member refers to a segment of a crimp ring for crimping a fitting, an actuator arm for actuating a crimp ring, or to a jaw arm for crimping a fitting.

The foregoing description of preferred and other embodiments is not intended to limit or restrict the scope or applicability of the inventive concepts conceived of by the Applicants or defined in the appended claims. In exchange for disclosing the inventive concepts contained herein, the Applicants desire all patent rights afforded by the appended claims. It is intended that the inventive concepts defined by the appended claims include all modifications and alterations to the full extent that such modifications or alterations come within the scope of the appended claims or the equivalents thereof.

What is claimed is:

1. An apparatus for crimping a fitting, comprising:

at least two generally C-shaped crimping members, each of the crimping members having first and second ends, the second ends each defining a pivot bore extending therethrough, the pivot bores being aligned and receiving a pivot pin such that the second ends of the crimping members are pivotably coupled together and the first ends of the crimping members are moveable relative to each other;

the crimping members defining actuator indentations adjacent the first ends for receiving an actuator such that the crimping members are closable by an actuator;

a stop attached to the first end of at least one of the crimping members and positioned for substantially stopping the closure of the crimping members at a predetermined position, wherein the stop is movable relative to the first end to allow adjusting the predetermined position.

2. The apparatus of claim 1, wherein the means positioned between the portions for substantially stopping the closure of the crimping members at the predetermined position comprises means for electronically sensing the predetermined position of closure between the portions.

3. The apparatus of claim 1, wherein the first ends of the crimping members each have a stop attached thereto.

4. The apparatus of claim 1, wherein the second end of one of the crimping members defines a bifurcate end, and wherein the second end of the other crimping member is positioned within the bifurcate end.

5. The apparatus of claim 1, wherein the first end of at least one of the crimping members defines a threaded hole, and wherein the stop includes a threaded member received in the threaded hole.

6. The apparatus of claim 1, wherein the first end of at least one of the crimping members defines a hole, and wherein the stop includes a fastener received in the hole.

7. The apparatus of claim 6, wherein the hole defined by the first end of at least one of the crimping members and the fastener are threaded, and wherein the fastener is received in the threaded hole.

8. An apparatus for crimping a fitting, comprising:

at least two crimping members, each of the crimping members having first and second ends, the second ends each defining a pivot bore extending therethrough, the pivot bores being aligned and receiving a pivot pin such that the second ends of the crimping members are pivotably coupled together and the first ends of the crimping members are moveable relative to each other;

the first end of at least one of the crimping members defining a hole therein;

a generally L-shaped adjustable stop having a first leg positioned between the first ends of the crimping members portions and preventing closure of the crimping members at a predetermined position, the stop having a second leg defining a hole therethrough; and a fastener extending through the hole in the second leg of the stop and into the hole in the first end of the crimping member to fasten the stop to the first end.

9. The apparatus of claim 8, wherein the crimping members are generally C-shaped.

10. The apparatus of claim 8, wherein the crimping members define actuator indentations adjacent the first ends for receiving the actuator.

11. The apparatus of claim 8, wherein the second end of one of the crimping members defines a bifurcate end, and wherein the second end of the other crimping member is positioned within the bifurcate end.

12. An apparatus for crimping a fitting, comprising:

at least two generally C-shaped crimping members, each of the crimping members having first and second ends, the second ends each defining a pivot bore extending therethrough, the pivot bores being aligned and receiving a pivot pin such that the second ends of the crimping members are pivotably coupled together and the first ends of the crimping members are moveable relative to each other;

the crimping members defining actuator indentations adjacent the first ends for receiving an actuator such that the crimping members are closable by an actuator;

the first end of at least one of the crimping members defining a threaded hole; and a stop having a threaded member received in the threaded hole to attach the stop to the first end of the at least one crimping member, the stop being positioned for substantially stopping the closure of the crimping members at a predetermined position.

13. The apparatus of claim 12, wherein the stop is movable relative to the first end to allow adjusting the predetermined position.

14. The apparatus of claim 12, wherein the first ends of the crimping members each have a stop attached thereto.

15. An apparatus for crimping a fitting, comprising:

at least two generally C-shaped crimping members, each of the crimping members having first and second ends, the second ends each defining a pivot bore extending therethrough, the pivot bores being aligned and receiving a pivot pin such that the second ends of the crimping members are pivotably coupled together and the first ends of the crimping members are moveable relative to each other;

the crimping members defining actuator indentations adjacent the first ends for receiving an actuator such that the crimping members are closable by an actuator;

the first end of at least one of the crimping members defining a hole; and a stop including a fastener received in the hole to attach the stop to the first end of the at least one crimping member, the stop being positioned for substantially stopping the closure of the crimping members at a predetermined position.

16. The apparatus of claim 15, wherein the hole defined by the first end of at least one of the crimping members and the fastener are threaded, and wherein the fastener is received in the threaded hole.

17. The apparatus of claim 15, wherein the stop is movable relative to the first end to allow adjusting the predetermined position.

18. The apparatus of claim 15, wherein the first ends of the crimping members each have a stop attached thereto.

* * * * *